US009459568B2

(12) United States Patent
Suzuki et al.

(10) Patent No.: US 9,459,568 B2
(45) Date of Patent: Oct. 4, 2016

(54) FIXING DEVICE AND IMAGE FORMING APPARATUS WITH DEFORMATION RESISTANT SUPPORTING STRUCTURE FOR SUPPORTING THERMISTOR

(71) Applicant: BROTHER KOGYO KABUSHIKI KAISHA, Nagoya, Aichi (JP)

(72) Inventors: Noboru Suzuki, Komaki (JP); Kentaro Sawano, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 14/588,518

(22) Filed: Jan. 2, 2015

(65) Prior Publication Data

US 2015/0192883 A1 Jul. 9, 2015

(30) Foreign Application Priority Data

Jan. 7, 2014 (JP) ..... 2014-000933

(51) Int. Cl.
*G03G 15/20* (2006.01)
*G03G 21/16* (2006.01)

(52) U.S. Cl.
CPC ..... *G03G 15/2039* (2013.01); *G03G 15/2017* (2013.01); *G03G 21/1619* (2013.01)

(58) Field of Classification Search
CPC ..... G03G 15/2017; G03G 15/2028; G03G 15/2039; G03G 15/2046; G03G 21/1619
USPC ..... 399/33, 69
See application file for complete search history.

(56) References Cited

U.S. PATENT DOCUMENTS

| | | | | |
|---|---|---|---|---|
| 5,070,231 | A * | 12/1991 | Bacus et al. | 219/216 |
| 5,906,762 | A * | 5/1999 | Okabayashi | 219/216 |
| 7,242,897 | B2 * | 7/2007 | Satoh et al. | 399/329 |
| 8,295,750 | B2 * | 10/2012 | Yamana | 399/328 |
| 2003/0170054 | A1 * | 9/2003 | Suzuki et al. | 399/328 |
| 2006/0289418 | A1 * | 12/2006 | Konishi et al. | 219/216 |
| 2011/0052236 | A1 | 3/2011 | Matsuno | |
| 2011/0164906 | A1 * | 7/2011 | Ishida et al. | 399/329 |
| 2014/0356038 | A1 * | 12/2014 | Arai et al. | 399/329 |

FOREIGN PATENT DOCUMENTS

JP 2011-048190 A 3/2011

* cited by examiner

*Primary Examiner* — David Gray
*Assistant Examiner* — Trevor J Bervik
(74) *Attorney, Agent, or Firm* — Scully, Scott, Murphy & Presser, P.C.

(57) ABSTRACT

A fixing device, including a heat roller, a temperature detector member to detect temperature of the heat roller, a supporting member to support the temperature detector member, and a fixer frame to support the heat roller and the supporting member, is provided. The supporting member includes a supporting part to support the temperature detector member, a first part, a second part which is less rigid than the first part, and an attaching part to be attached to an attachable surface of the fixer frame. The attaching part is arranged on one end of the supporting member along the axial direction. The supporting part is arranged in an intermediate position along the axial direction in the supporting member. The first part and the second part are arranged in positions between the attaching part and the supporting part along the axial direction in the supporting member.

23 Claims, 17 Drawing Sheets

| | | YOUNG' S MODULUS [MPa] | LINEAR EXPANSION COEFFICIENT [×10-6/°C] |
|---|---|---|---|
| FC01 | MACHINE DIRECTION | 7810 | 9.7 ~ 27 |
| | CROSS DIRECTION | 4470 | 65 ~ 91 |
| steel | | 203000 | 8.3 |
| POM | | 2000 | 90 |

FIG. 13

FIXING DEVICE AND IMAGE FORMING APPARATUS WITH DEFORMATION RESISTANT SUPPORTING STRUCTURE FOR SUPPORTING THERMISTOR

CROSS REFERENCE TO RELATED APPLICATION

This application claims priority from Japanese Patent Application No. 2014-000933, filed on Jan. 7, 2014, the entire subject matter of which is incorporated herein by reference.

BACKGROUND

1. Technical Field

An aspect of the present invention relates to a fixing device and an image forming apparatus, which are configured to fix an image formed in a developer agent thermally on a recording sheet.

2. Related Art

A fixing device including a heat roller, a thermistor, a supporting member, and a fixer frame is known. The thermistor may be arranged to face the heat roller along a radial direction of the heat roller and detect temperature of the heat roller. The supporting member may support the thermistor. The fixer frame may support axial ends of the heat roller and ends of the supporting member. The supporting member may be formed in an elongated plate extending lengthwise along an axial direction of the heat roller, and a breadth of the supporting member may be constant throughout the length thereof except for a lengthwise central part that supports the thermistor.

SUMMARY

With the above-mentioned supporting structure, however, if the fixer frame is bowed into an arch by, for example, an effect of thermal expansion, the supporting member may also be bowed, and an amount of a gap between the thermistor and the heat roller supported by the supporting member may be undesirably changed.

The present invention is advantageous in that a fixing device and an image forming apparatus, in which the amount of the gap between the thermistor and the heat roller is restrained from changing even when the fixer frame is deformed, is provided.

According to an aspect of the present invention, a fixing device; including a heat roller; a temperature detector member arranged to face with an outer periphery of the heat roller along a facing direction and configured to detect temperature of the heat roller, a supporting member formed in a shape of a plate elongated along an axial direction of the heat roller and spreading to intersect with the facing direction, the supporting member being configured to support the temperature detector member; and a fixer frame configured to support end portions of the heat roller and end portions of the supporting member, is provided. The supporting member includes a supporting part configured to support the temperature detector member; a first part having a predetermined degree of rigidity; a second part, of which rigidity is lower than the rigidity of the first part; an attaching part configured to be attached to an attachable surface of the fixer frame, the attachable surface spreading orthogonally to the facing direction. The supporting part, the first part, the second part, and the attaching part are arranged such that the attaching part is arranged on one end of the supporting member along the axial direction, that the supporting part is arranged in an intermediate position along the axial direction in the supporting member, and that the first part and the second part are arranged in positions between the attaching part and the supporting part along the axial direction in the supporting member.

According to another aspect of the present invention, an image forming apparatus, including a fixing device and a main frame configured to support the fixing device, is provided. The fixing device includes a heat roller; a temperature detector member arranged to face with an outer periphery of the heat roller along a facing direction and configured to detect temperature of the heat roller; a supporting member formed in a shape of a plate elongated along an axial direction of the heat roller and spreading to intersect with the facing direction, the supporting member being configured to support the temperature detector member; and a fixer frame configured to support end portions of the heat roller and end portions of the supporting member. The supporting member includes a supporting part configured to support the temperature detector member; a first part having a predetermined degree of rigidity; a second part, of which rigidity is lower than the rigidity of the first part; and an attaching part configured to be attached to an attachable surface of the fixer frame, the attachable surface spreading orthogonally to the facing direction. The supporting part, the first part, the second part, and the attaching part are arranged such that the attaching part is arranged on one end of the supporting member along the axial direction, that the supporting part is arranged in an intermediate position along the axial direction in the supporting member, and that the first part and the second part are arranged in positions between the attaching part and the supporting part along the axial direction in the supporting member.

BRIEF DESCRIPTION OF THE ACCOMPANYING DRAWINGS

Figure 6A:
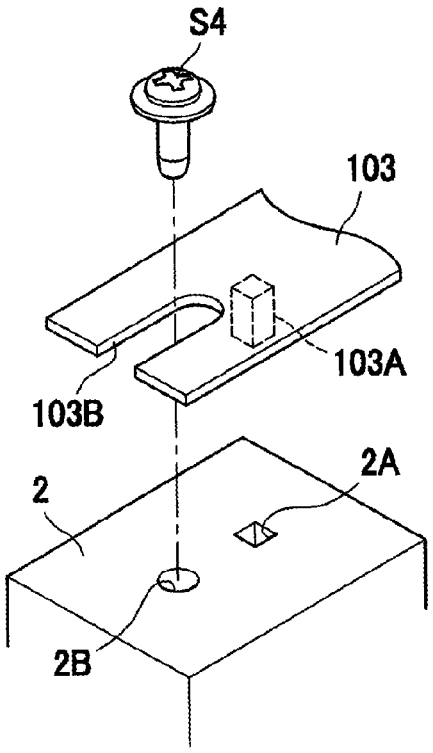
Figure 6C:
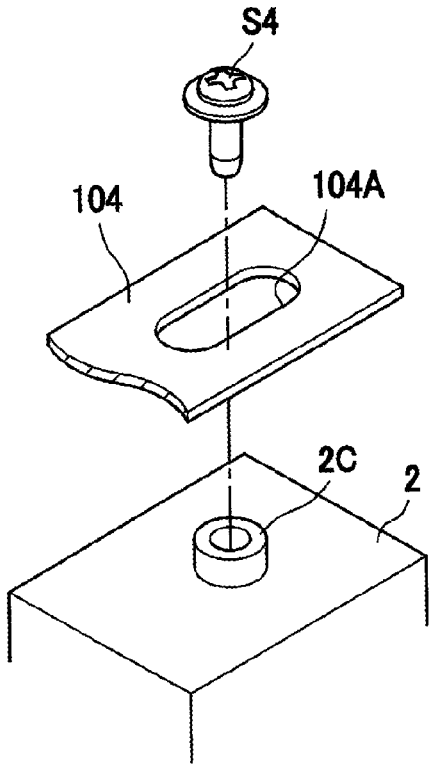
Figure 6B:
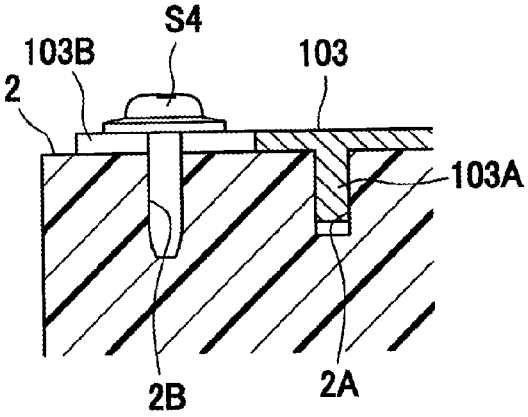
Figure 6D:
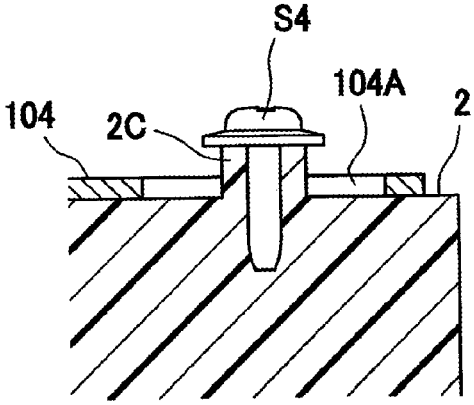

FIGS. 6A and 6C are exploded views of a leftward end and a rightward end of a fixer frame respectively with a main frame in the laser printer according to the embodiment of the present invention. FIGS. 6B and 6D are cross-sectional views of the leftward end and the rightward end of the fixer frame respectively with the main frame in the laser printer according to the embodiment of the present invention.

Figure 7A:
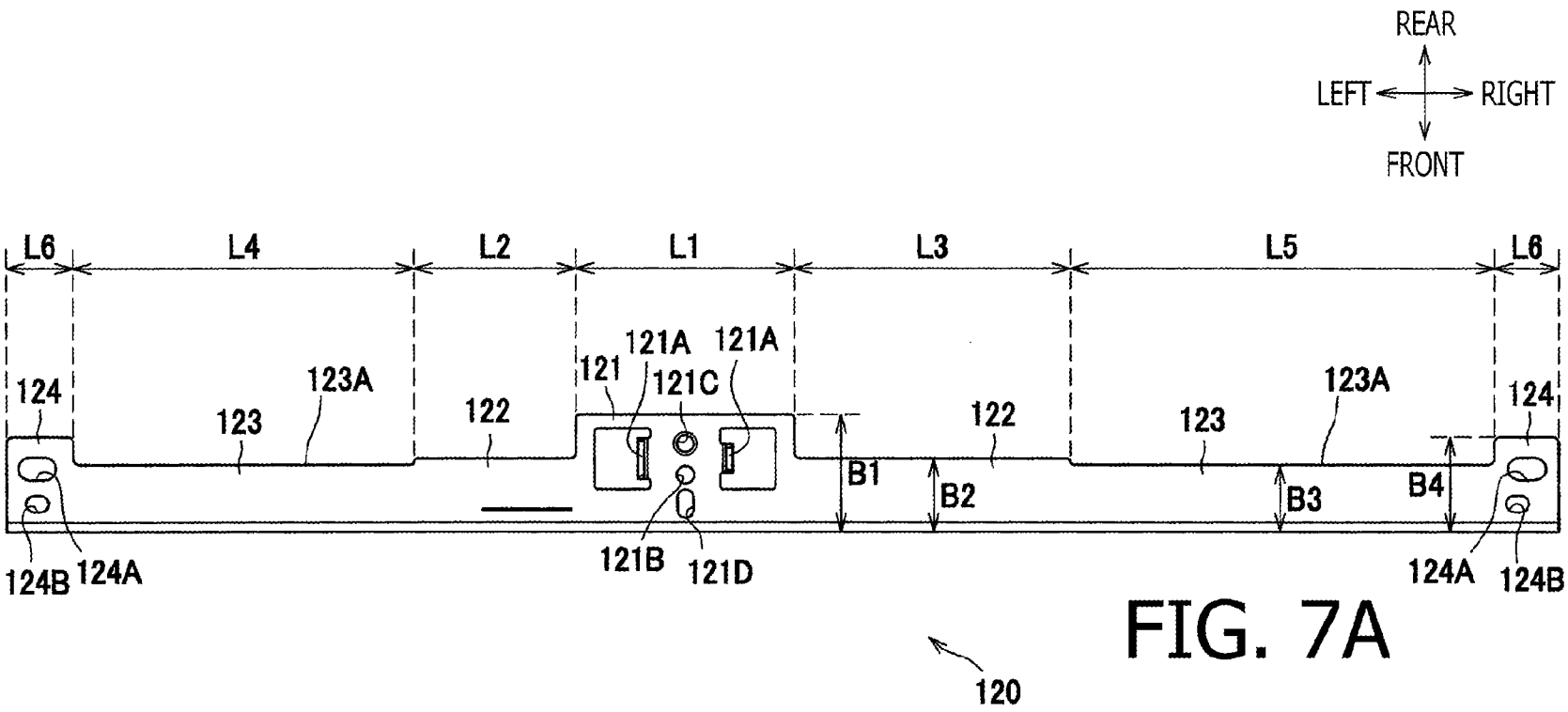
Figure 7B:
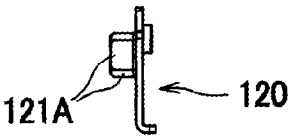

FIG. 7A is a plan view of the thermistor in the laser printer according to the embodiment of the present invention. FIG. 7B is a side view of the thermistor in the laser printer according to the embodiment of the present invention.

Figure 8:
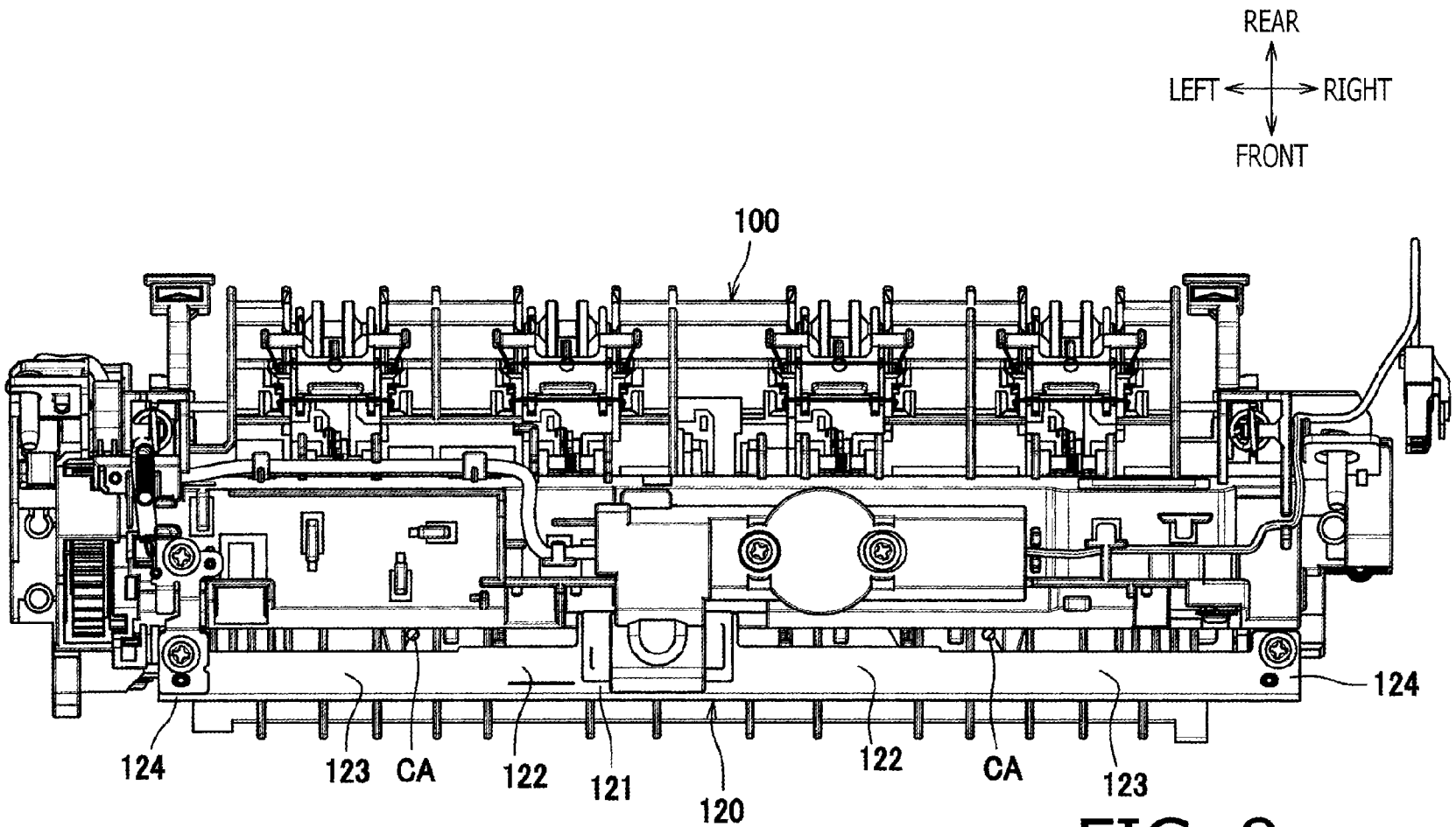

FIG. 8 is a top plan view of the fixing device according to the embodiment of the present invention.

Figure 9:
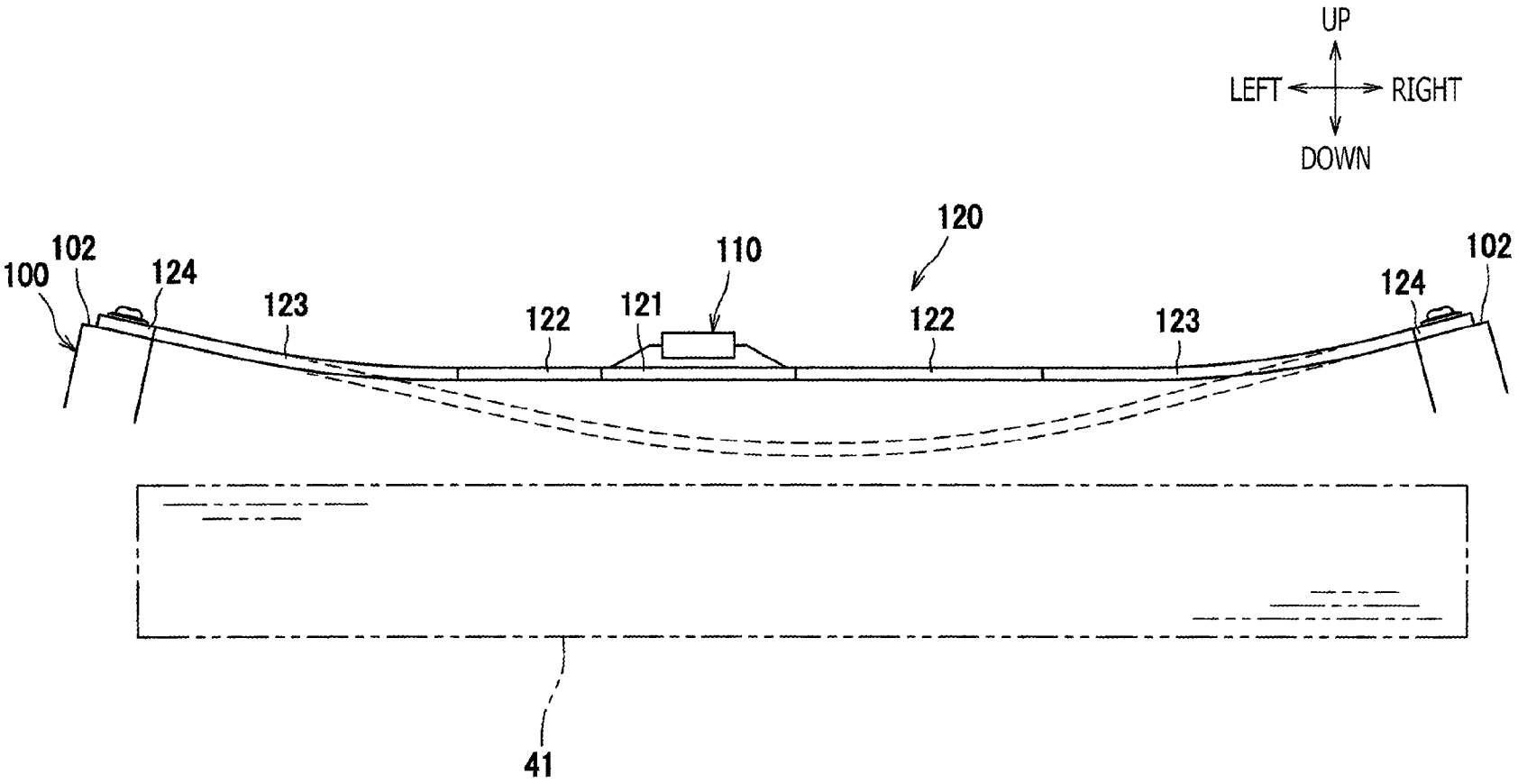

FIG. 9 is an illustrative view of deformation of the thermistor plate and positional relation between the central thermistor and the heat roller in the fixing device according to the embodiment of the present invention.

Figure 10A:
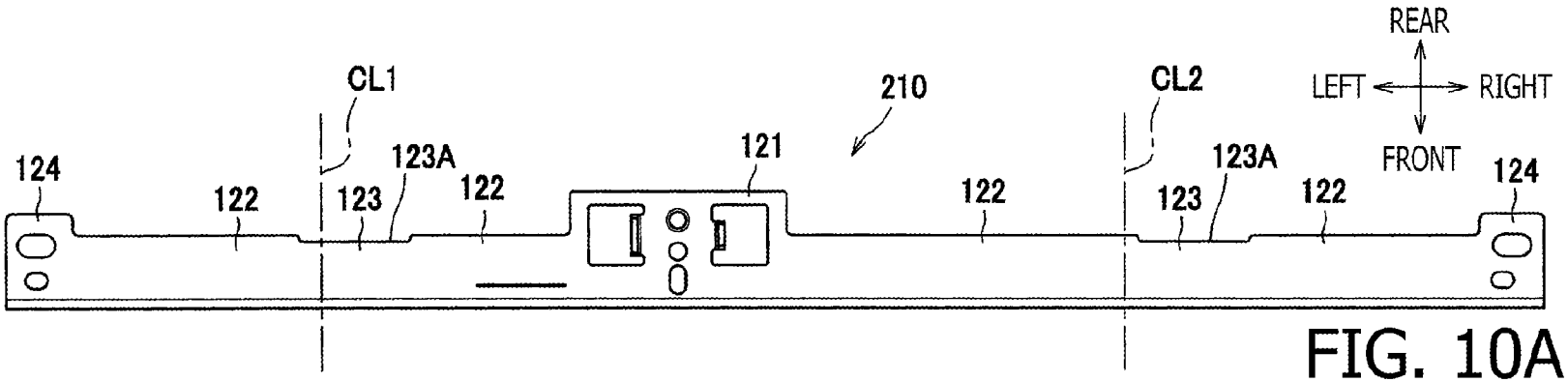
Figure 10B:
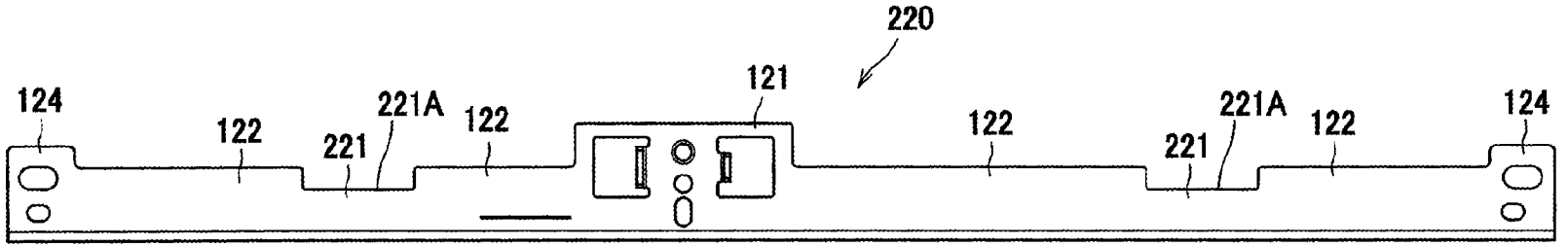
Figure 10C:
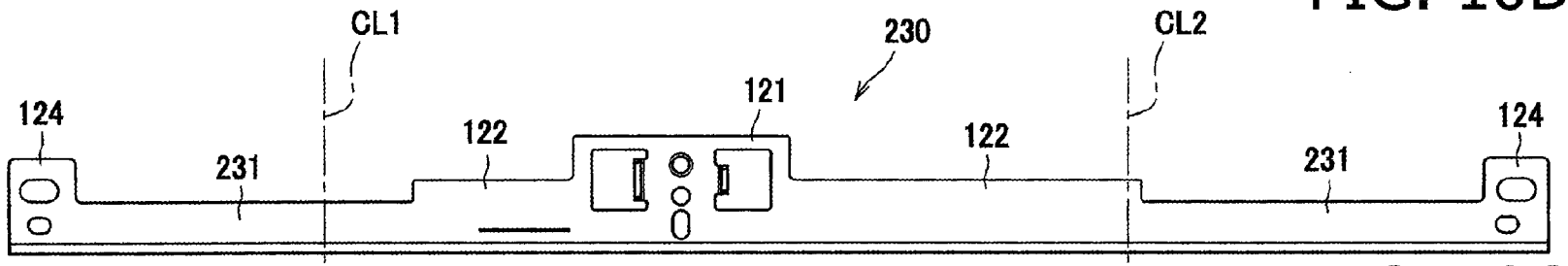

FIGS. 10A-10C are modified examples of the thermistor plate in the fixing device according to the embodiment of the present invention.

Figures 11A, 11B, 11C:
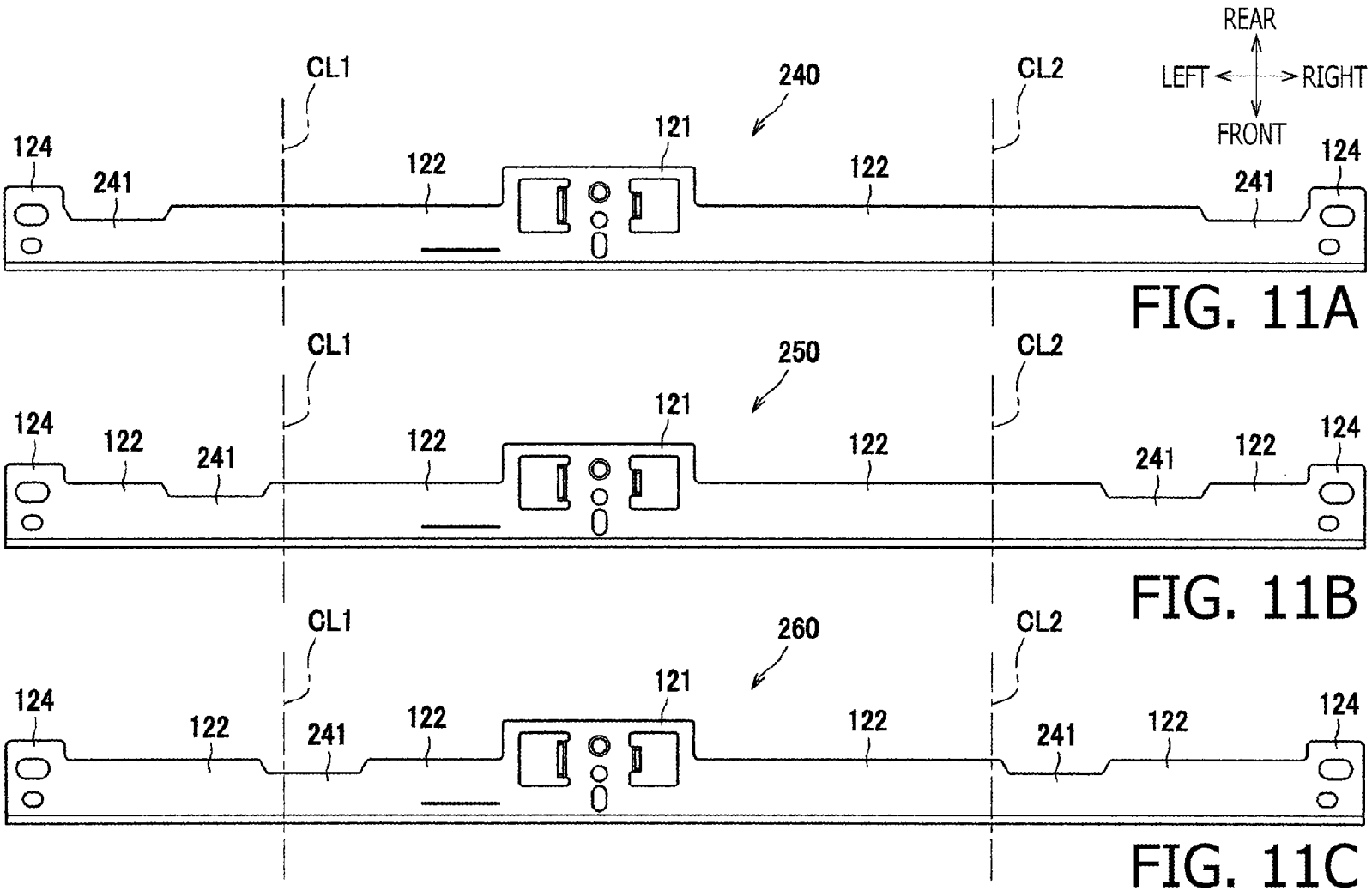

FIGS. 11A-11C are another modified examples of the thermistor plate in the fixing device according to the embodiment of the present invention.

Figure 12A:
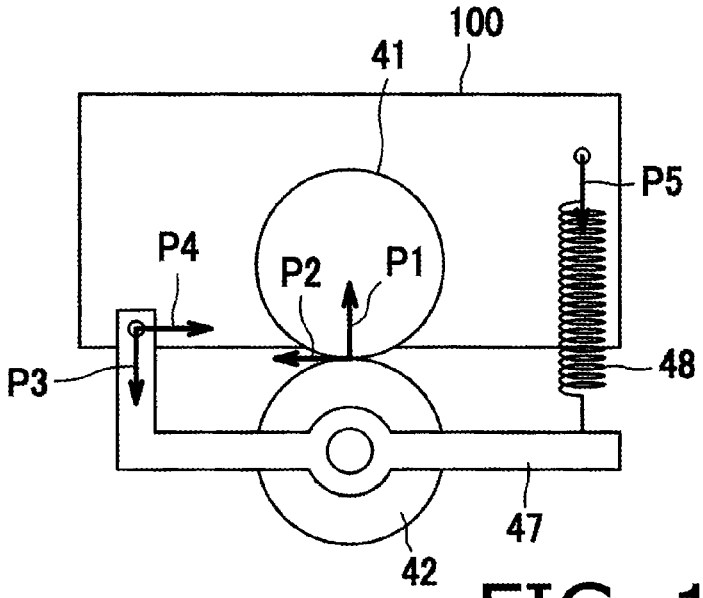
Figure 12B:
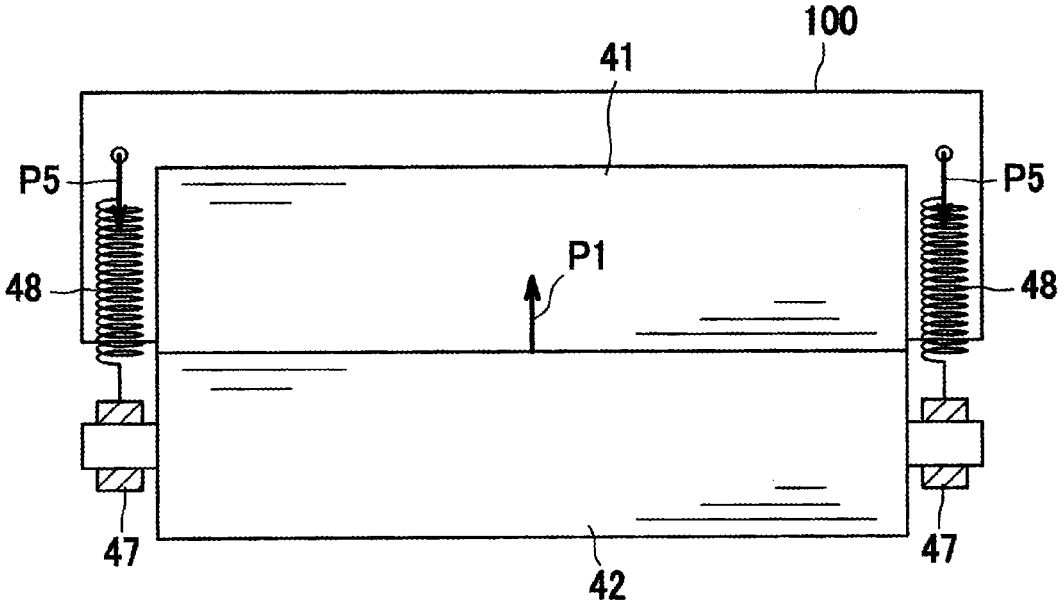

FIG. 12A is a side view of the fixing device to illustrate forces to be applied to the fixer frame of the fixing device according to the embodiment of the present invention. FIG. 12B is a front view of the fixing device to illustrate the forces to be applied to the fixer frame of the fixing device according to the embodiment of the present invention.

FIG. 13 is a table to indicate Young's modulus and a linear expansion coefficient for each employed material according to the embodiment of the present invention.

Figure 14:
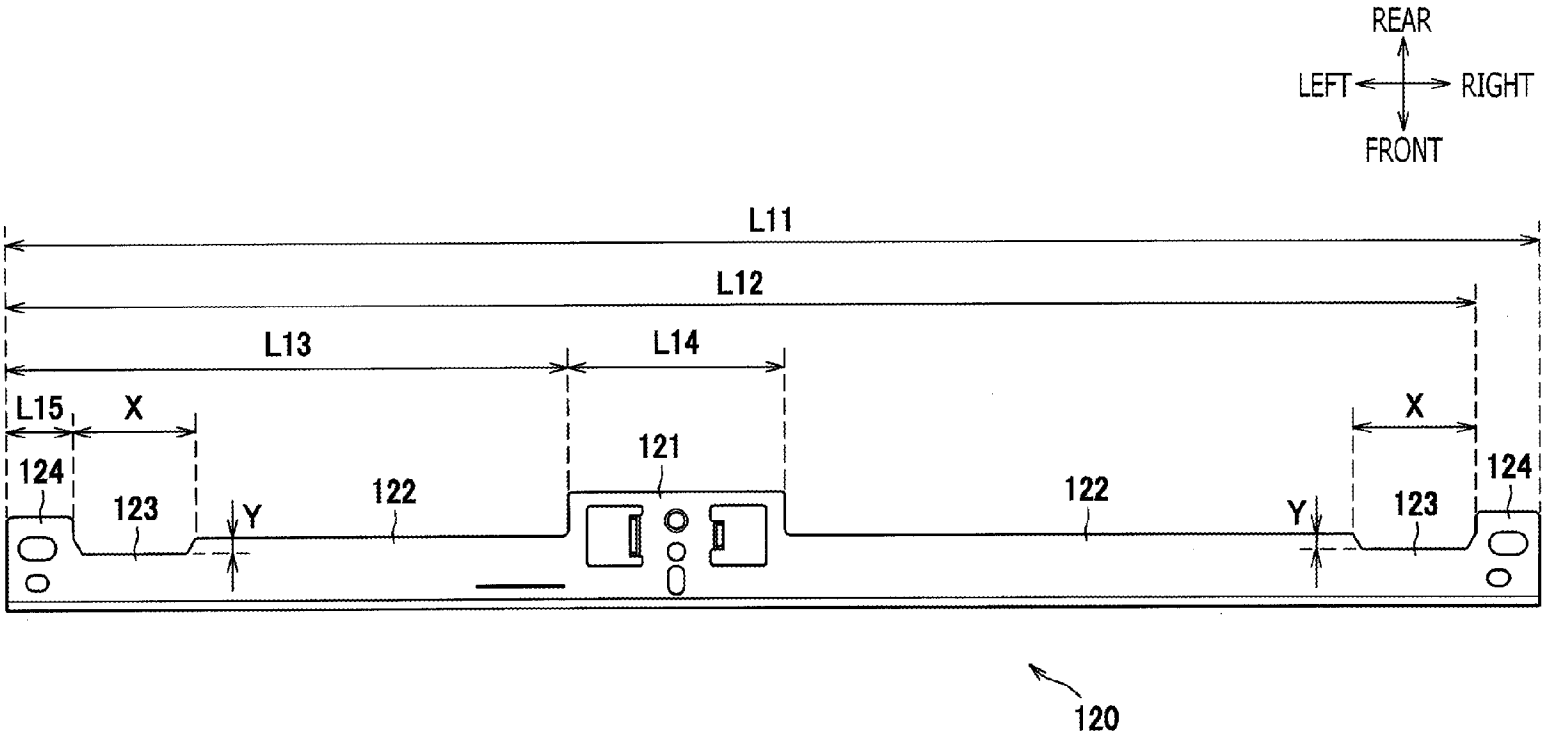

FIG. 14 is a plan view of the thermistor plate to be used in a simulation, illustrating a relative dimension of each part according to the embodiment of the present invention.

Figure 15:
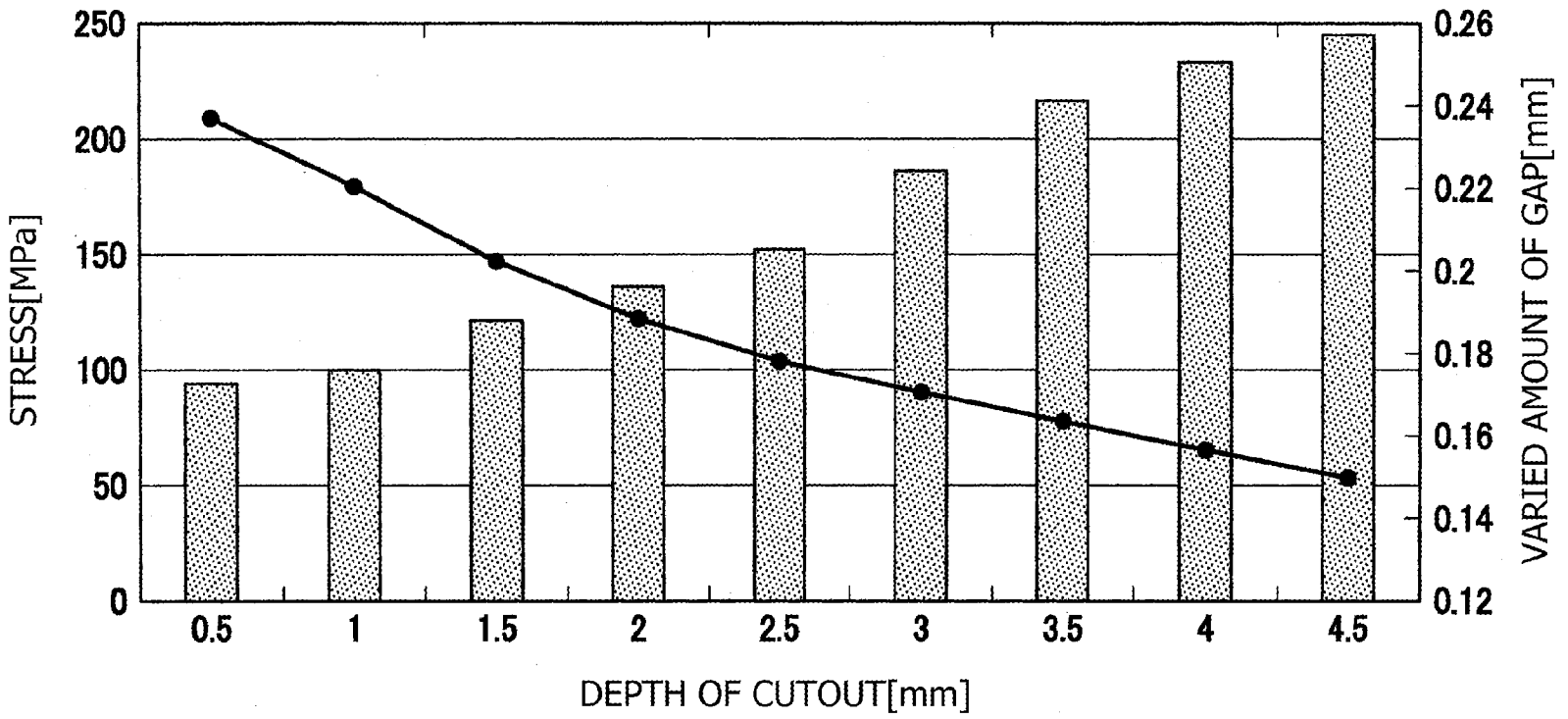

FIG. 15 is a graph to illustrate interrelation among a depth of cutouts, stress, and variable amounts of a gap in the fixing device according to the embodiment of the present invention.

Figure 16:
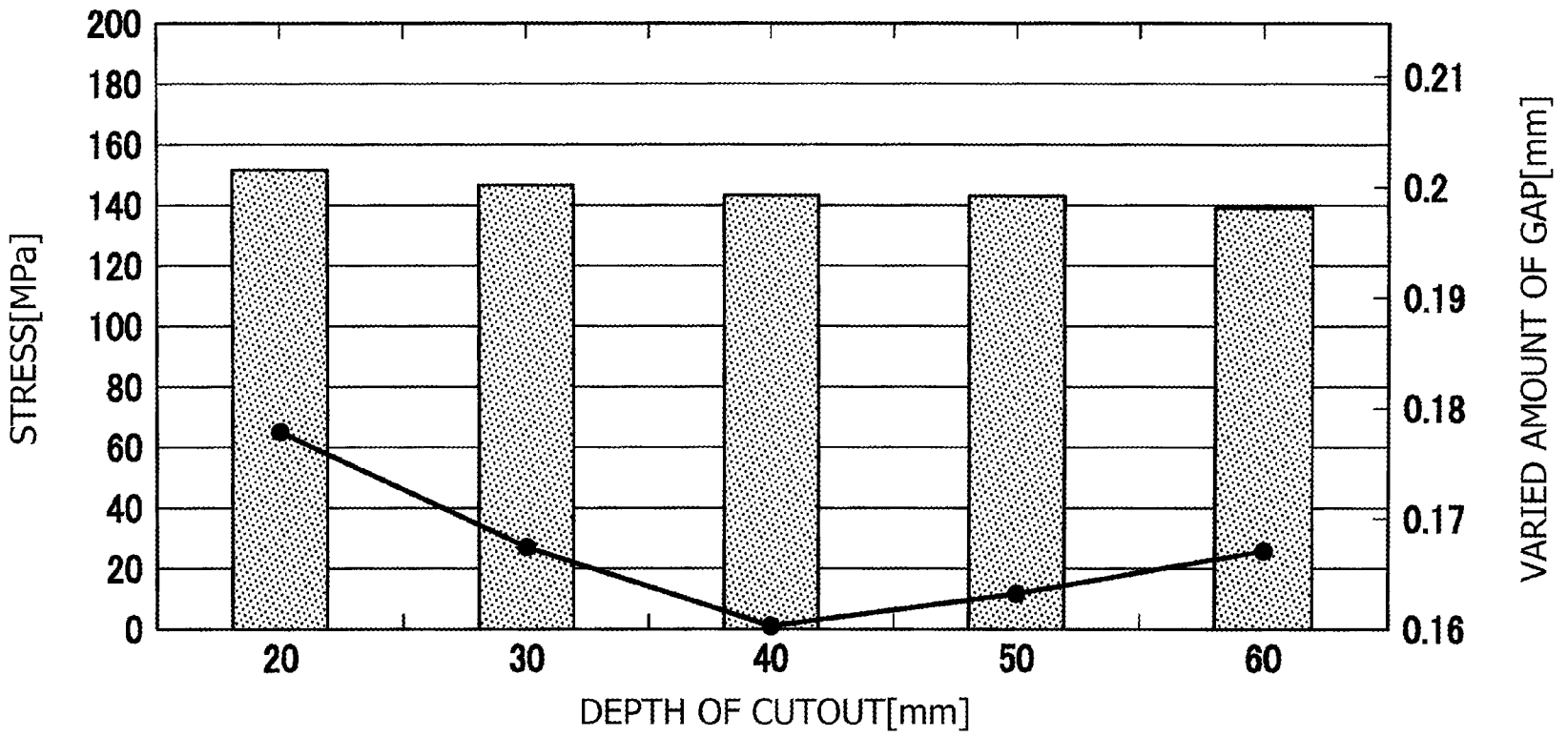

FIG. 16 is a graph to illustrate interrelation among a width of the cutouts, stress, and variable amounts of the gap in the fixing device according to the embodiment of the present invention.

Figure 17:
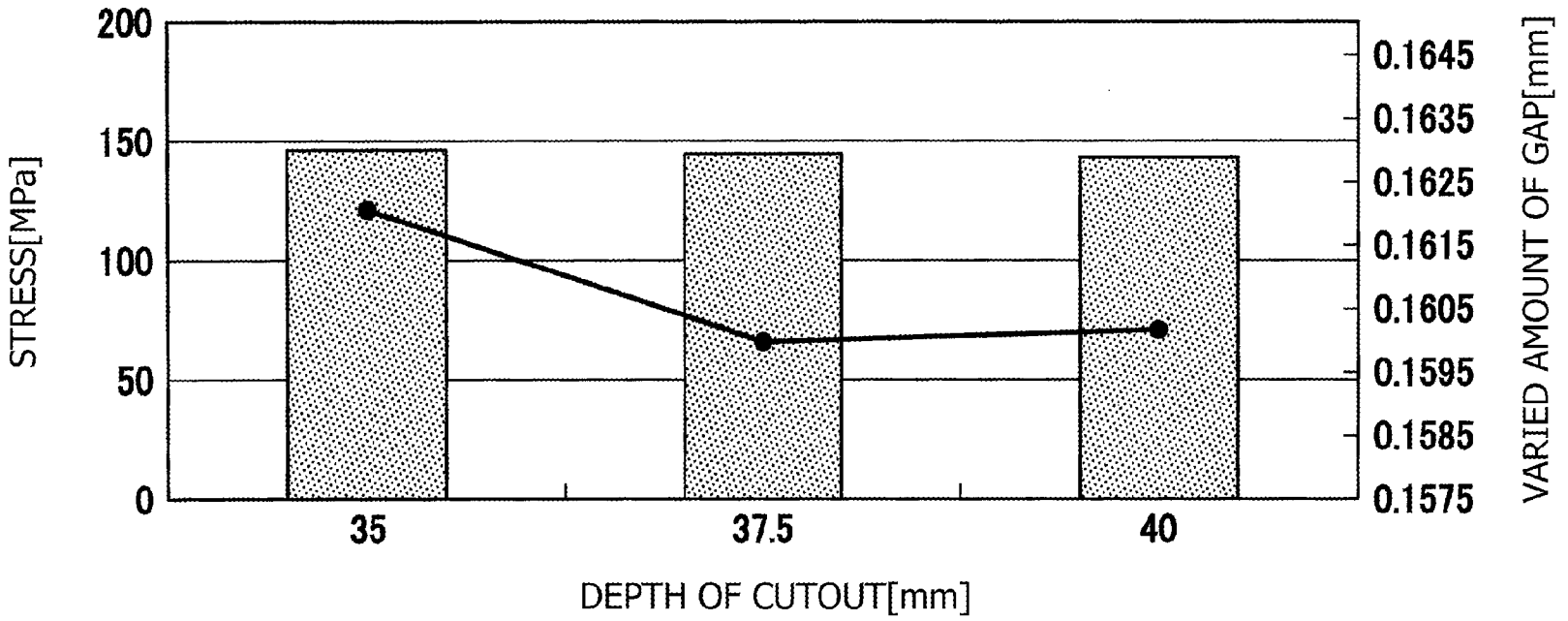

FIG. 17 is a graph to illustrate interrelation among the width of the cutouts, stress, and variable amounts of the gap in the fixing device according to the embodiment of the present invention when the width of the cutout is changed at a smaller interval.

DETAILED DESCRIPTION

Hereinafter, a configuration of a laser printer 1 according to the embodiment of the present invention will be described with reference to the accompanying drawings. First, an overall configuration of the laser printer 1 will be described, and second, specific components in the laser printer 1 will be described in detail.

Figure 1:
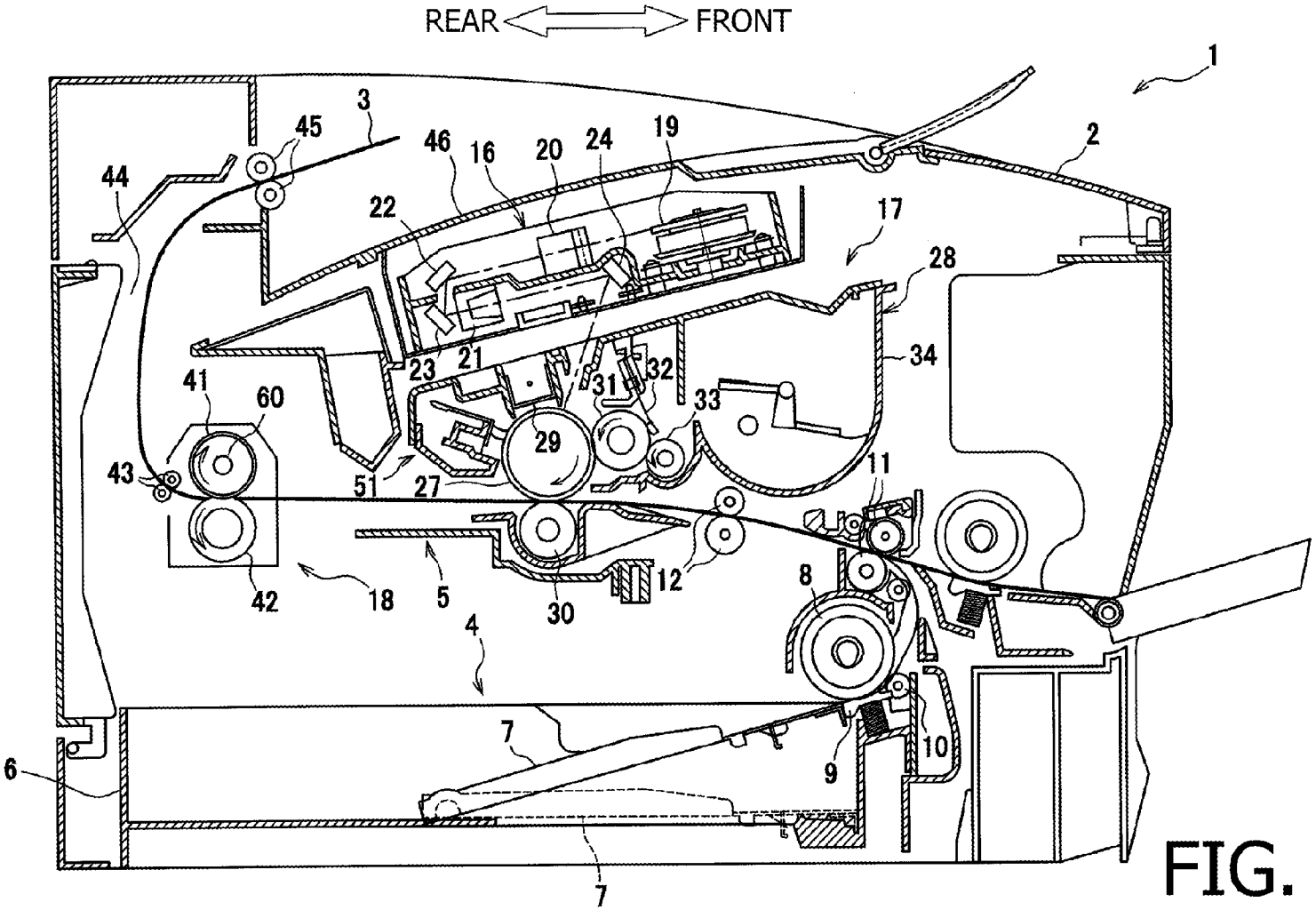
FIG. 1 is a cross-sectional view of a laser printer according to an embodiment of the present invention.

In the following description, directions concerning the laser printer 1 will be referred to in accordance with orientation indicated by arrows in the drawings. Therefore, for example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is a left-hand for a user facing the front side, and an opposite side from the left, which corresponds to the viewer's farther side is a right-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-12 are similarly based on the orientation of the laser printer 1 as defined above and correspond to those with respect to the laser printer 1 shown in FIG. 1 even when the drawings are viewed from different angles.

As shown in FIG. 1, the laser printer 1 includes a feeder unit 4 to feed sheets 3 and an image forming unit 5 to form images on the sheets 3 being fed. The feeder unit 5 and the image forming unit 5 are arranged in a main frame 2.

The feeder unit 4 includes a feeder tray 6, which is detachably attached to a bottom part in the main frame 2, and a sheet pressing plate 7, which is arranged in the feeder tray 6. The feeder unit 4 further includes a feeder roller 8 and a feeder pad 9, which are arranged in upper-frontward positions with respect to the feeder tray 6, and dust-remover rollers 10, 11, which are arranged on a downstream side of the feeder roller 8 with regard to a conveying direction to convey the sheets 3. Furthermore, the feeder unit 4 includes registration rollers 12, which are arranged on a downstream side of the dust-remover rollers 11 with regard to the conveying direction.

With the feeder unit 4 configured as above, the sheets 3 in the feeder tray 6 are uplifted by the sheet pressing plate 7 to be closer to the feeder roller 8, separated and forwarded one-by-one by the feeder roller 8 and the feeder pad 9, turned over at a front side in the main frame 2, and passed through the rollers 10-12 to be conveyed rearward from the front side of the main frame 2 to the image forming unit 5.

The image forming unit 5 includes a scanner unit 16, a processing cartridge 17, and a fixing device 18.

The scanner unit 16 is arranged in an upper position in the main frame 2 and includes a laser emitter (not shown), a rotatably-driven polygon mirror 19, lenses 20, 21, and mirrors 22, 23, 24. In the scanner unit 16, laser beam emitted from the laser emitter travels a path indicated by a dash-and-dot line shown in FIG. 1 and scans a surface of a photosensitive drum 27 in the processing cartridge 17.

The processing cartridge 17 is arranged in a lower position with respect to the scanner unit 16 and is detachably attached to the main frame 2. The processing cartridge 17 includes a developer cartridge 28 and a drum unit 51.

The developer cartridge 28 includes a developer roller 31, a spreader blade 32, a feeder roller 33, and a toner container 34. Toner in the toner container 34 is agitated by an agitator (unsigned) and supplied to the developer roller 31 by the supplier roller 33. In this regard, the toner is positively charged frictionally between the supplier roller 33 and the developer roller 31. The toner supplied to the developer roller 31 enters a position between the spreader blade 32 and the developer roller 31 and is flattened to form a layer of a predetermined thickness on the developer roller 31.

The drum unit 51 includes the photosensitive drum 27, a scorotron-typed charger 29, and a transfer roller 30. In the drum unit 51, a surface of the photosensitive drum 27 is evenly charged by the charger 29 positively and is selectively exposed to the scanning laser beam from the scanner unit 16 according to image data. Thereby, potential in the area exposed to the laser beam is lowered, and an electrostatic latent image corresponding to the image data is formed on the surface of the photosensitive drum 27.

Meanwhile, as the developer roller 31 rotates, and when the toner carried on the developer roller 31 faces and contact the surface of the photosensitive drum 27, the toner is supplied to the electrostatic latent image on the photosensitive drum 27. Thus, the electrostatic latent image is developed to be a visible toner image on the surface of the photosensitive drum 27. Thereafter, while the sheet 3 is conveyed through a position between the photosensitive drum 27 and the transfer roller 30, the toner image carried on the surface of the photosensitive drum 27 is transferred onto the sheet 3.

The fixing device 18 is supported by the main frame 2 and includes a heat roller 41 and a pressure roller 52. The heat roller 41 contains a halogen lamp 60 therein. The pressure roller 42 is urged against the heat roller 41. In the fixing device 18, with the heat roller 41 heated by the halogen lamp 60, the toner image transferred onto the sheet 3 is thermally fixed thereat while the sheet 3 passes through a position between the heat roller 41 and the pressure roller 42.

The sheet 3 is thereafter conveyed by the conveyer rollers 43 to an ejection path 44 and ejected by ejection rollers 45 to be disposed on an ejection tray 46.

Figure 2:
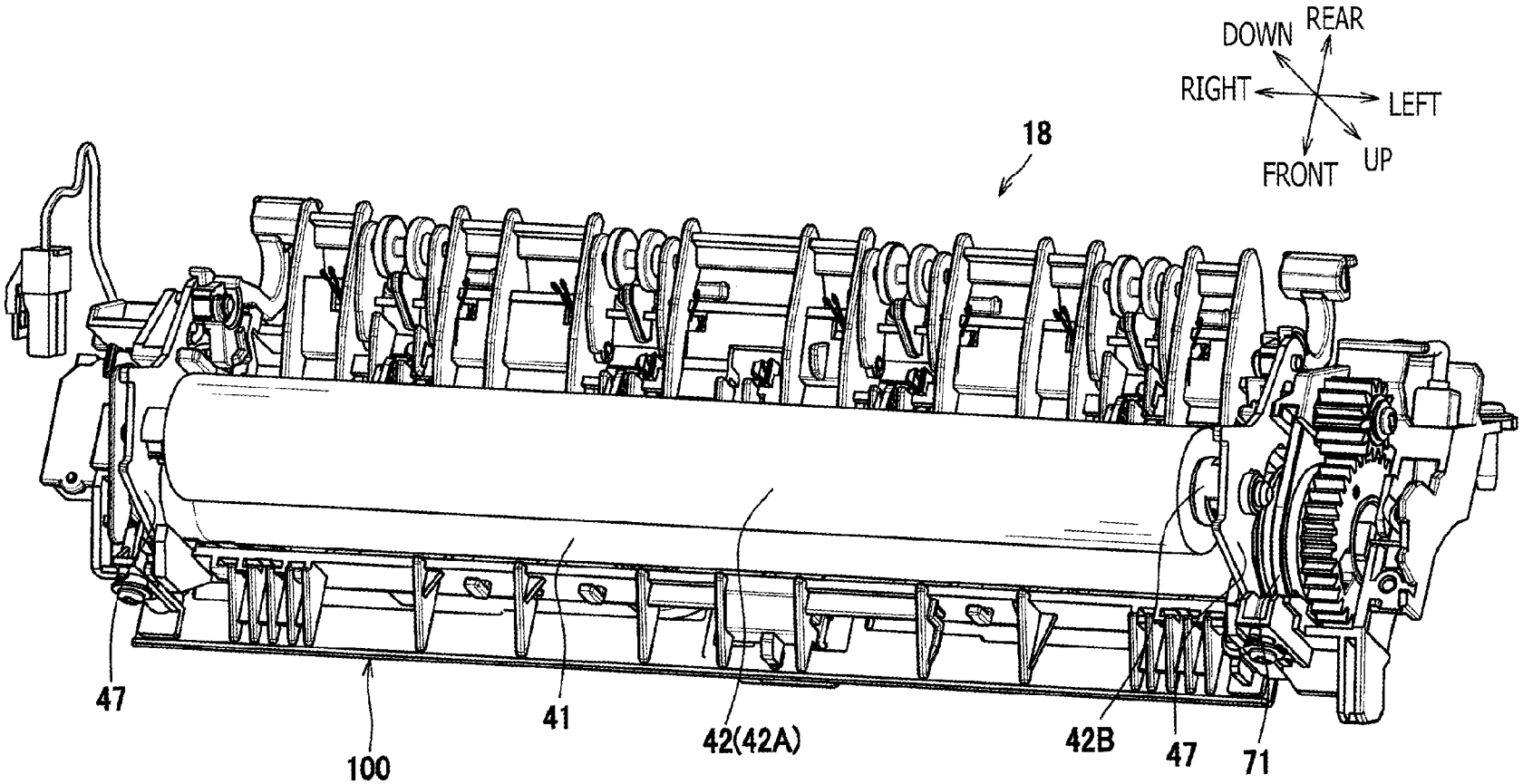
FIG. 2 is an upward perspective view of a fixing device according to the embodiment of the present invention.

Next, detailed configuration of the fixing device 18 will be described below. As shown in FIG. 2, the fixing device 18 includes, additionally to the heat roller 41 and the pressure roller 42, a fixer frame 100 to support these parts in the fixing device 18.

The heat roller 41 is a metal-made cylindrical roller elongated along the widthwise direction, and longitudinal ends thereof are rotatably supported by two (2) bearings 71 (solely one of the two is shown in FIG. 2), which are supported by the fixer frame 100 so that the heat roller 41 is rotatable about an axis AL (see FIG. 5), which extends along the widthwise direction. The fixer frame 100 is formed to have a shape to substantially cover an upper half of the heat roller 41; in other words, the heat roller 41 is partly accommodated in the fixer frame 100 at the upper half thereof.

The pressure roller 42 includes a roller body 42A and a rotation shaft 42B. The roller body 42A is a cylindrical member made of a resiliently deformable material such as rubber. The rotation shaft 42B is arranged to penetrate through the roller body 42 longitudinally. Longitudinal ends of the rotation shaft 42B are rotatably supported by supporting arms 47, which are swingably supported by widthwise ends of the fixer frame 100.

The supporting arms 47 are rotatably supported by the fixer frame 100 at frontend portion thereof, and rear-end portions thereof are attached to the fixer frame 100 through tension springs (not shown). The supporting arms 47 support the pressure roller 42 at an approximately central portion thereof with regard to the front-rear direction. While the rear-end portions of the supporting arms 47 are urged toward the fixer frame 100 by the tension springs, the pressure roller 42 is urged against the heat roller 41 by the supporting arms 47.

Figure 3:
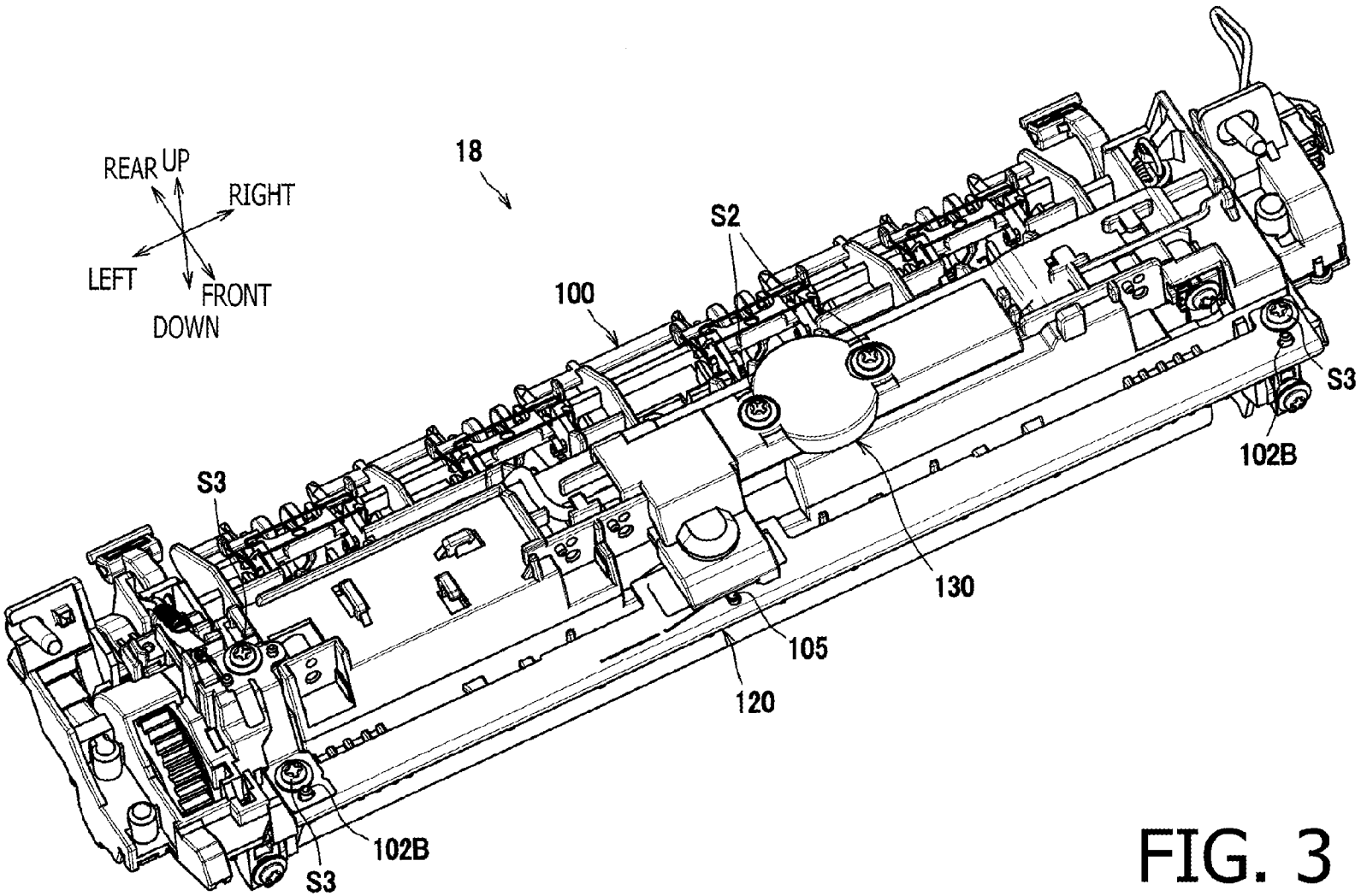
FIG. 3 is a downward perspective view of the fixing device according to the embodiment of the present invention.
Figures 4A, 4B:
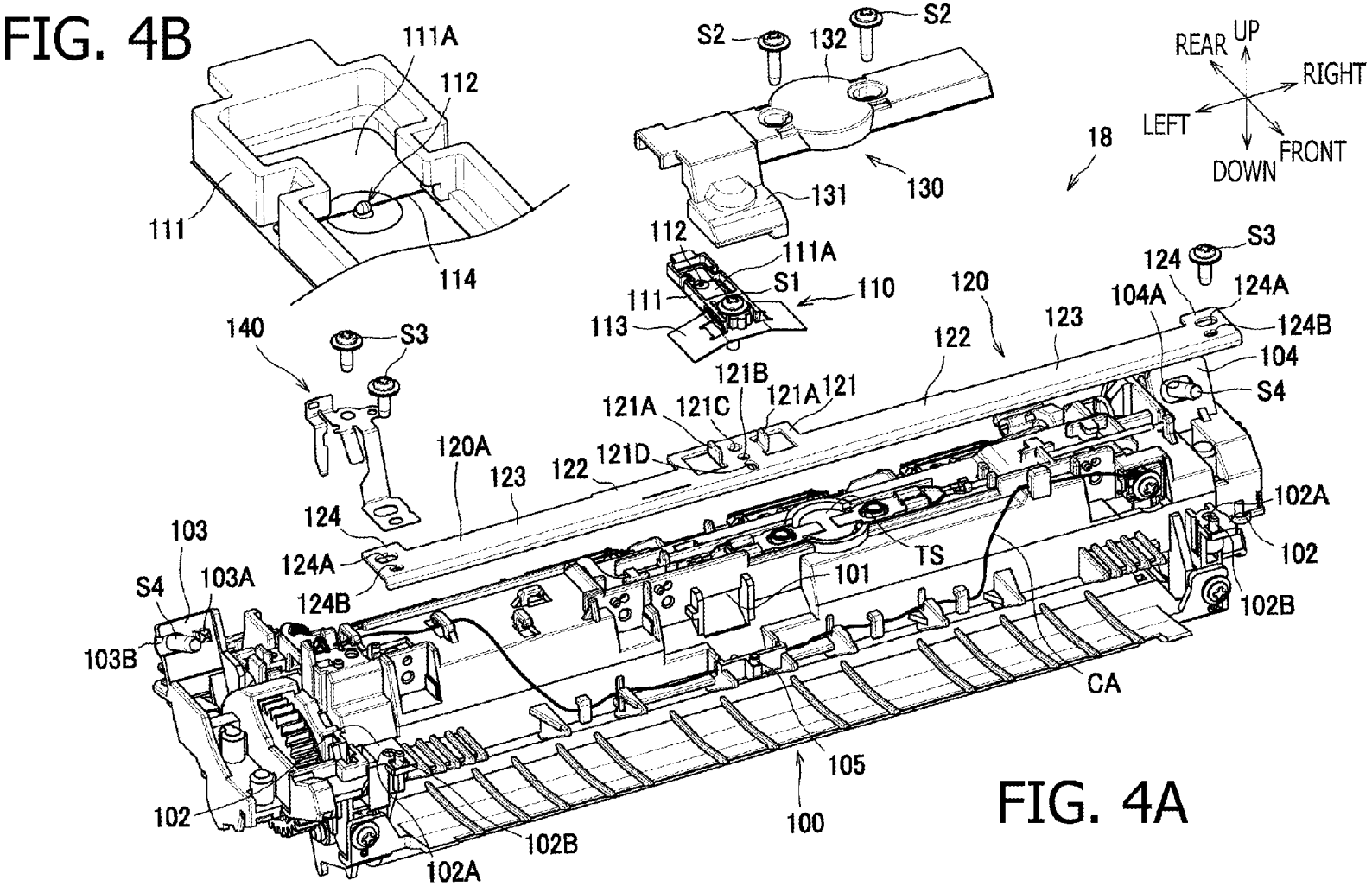
FIG. 4A is an exploded view of the fixing device with a thermistor plate according to the embodiment of the present invention.
FIG. 4B is a partially enlarged view of a central thermistor in the fixing device according to the embodiment of the present invention.

The fixing device 18 includes a central thermistor 110, a thermistor plate 120, a cover 130, and ground piece 140, as shown in FIGS. 3 and 4A-4B.

Figure 5:
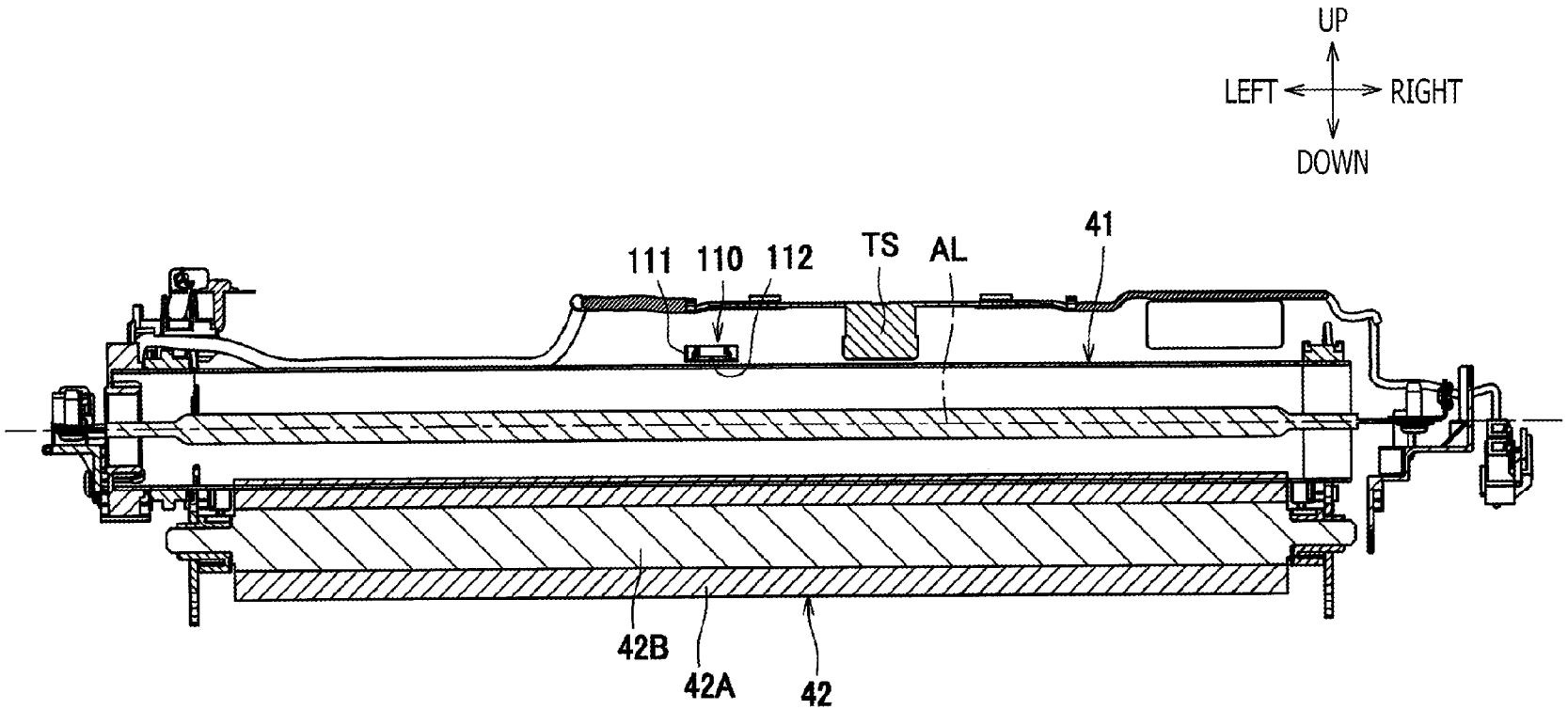
FIG. 5 is a cross-sectional view of the fixing device to illustrate positional interrelation between the central thermistor and the heat roller according to the embodiment of the present invention.

The central thermistor 110 is a non-contact sensor for detecting temperature of a central area of the heat roller 41. The central thermistor 110 is arranged to face with and spaced apart from an outer periphery of the heat roller 41 (see FIG. 5). In FIG. 5, the fixer frame 100 is omitted.

The central thermistor 110 includes a sensor-supporting member 111, a film 111A, a detector member 112, and a blade spring 113. The sensor-supporting member 111 is a quadrilateral piece elongated along the front-rear direction. The film 111A is supported by a frame formed at a rearward part of the sensor-supporting member 111. The detector member 112 is supported at a central part of the film 111A. The detector member 112 is electrically connected to a wire 114 and detects electric resistance in the wire 114. The blade spring 113 is arranged at a frontend part of the sensor-supporting member 111.

The sensor-supporting member 111 is fastened by a screw S1 at a frontend portion thereof to a central part, i.e., a supporting part 121, of the thermistor plate 120 through the blade spring 113 and is arranged to locate a rear-end portion thereof to protrude rearward from the thermistor plate 120. The rear-end portion of the sensor-supporting member 111 is inserted in the fixer frame 100 through an opening 101, which is formed in the fixer frame 100; thereby, the detector member 112 is arranged in an upper position with respect to the heat roller 41 to face with the heat roller 41 along the vertical direction (see FIG. 5) along a facing direction. The facing direction, along which the detector member 112 faces with the heat roller 41, is parallel with a line extending through the axis AL of the heat roller 41 and a center of the detector member 112 along a radial direction of the heat roller 41.

Meanwhile, the blade spring 113 urges the sensor-supporting member 111 upward toward a head of the screw S1. Therefore, an amount of a gap between the detector member 112 and the heat roller 41 may be preferably adjusted by adjusting a screwing angle of the screw S1.

The cover 130 includes a first cover part 131 to cover the central thermistor 110 from above and a second cover part 132 to cover a thermostat TS from above. The cover 130 is fixed to the fixer frame 100 by two (2) screws S2.

The fixer frame 100 is formed to have a pair of attachable surfaces 102, to which widthwise end portions of the thermistor plate 120 are attached. Each of the attachable surfaces 102 spreads orthogonally to the vertical direction. On each attachable surface 102, a screw hole 102A, in which a screw S3 to fasten the thermistor plate 120 is screwed, and a projection 102B, by which a position of the thermistor plate 120 with regard to the front-rear direction is defined, are formed. In this regard, the orthogonal direction for the attachable surface 102 to spread with respect to the vertical direction refers to 90 degrees, and additionally with a margin of error or tolerance of plus or minus 5 degrees, with respect to the vertical direction.

The fixer frame 100 includes a first attachment section 103 at a leftward end portion thereof and a second attachment section 104 at a rightward end portion thereof. Through the first attachment section 103, the fixer frame 100 is fixed to the main frame 2. The second attachment section 104 is supported by the main frame 2 movably along the widthwise direction. As shown in FIGS. 6A-6B, the first attachment section 103 includes a positioning projection 103A and a cutout 103B. The positioning projection 103A is formed in a shape of a quadratic prism and protrudes toward the main frame 2. The cutout 103B is formed to have a shape of a "U" which is open outward along the widthwise direction, and a screw S4 to fasten the fixer frame 100 to the main frame 2 is inserted in the cutout 103B through the first attachment section 103. Meanwhile, in the main frame 2, a rectangular positioning hole 2A and a screw hole 2B are formed in an area where the first attachment section 103 is attached so that the positioning projection 103A is fitted in the positioning hole 2A, and the screw S4 is screwed into the screw hole 2B. Thus, the leftward end portion of the fixer frame 100 is placed in and fixed to a correct position with respect to the main frame 2 by the engagement of the positioning projection 103A with the positioning hole 2A and by the fastening force of the screw S4. In other words, the leftward end portion of the fixer frame 100 is restricted from moving in any direction by the main frame 2. In particular, with regard to the movement in the widthwise direction, the leftward end portion of the fixer frame 100 is restricted from moving by lateral inner edges of the positioning hole 2A on the right and left. More specifically, engagement of the positioning projection 103A with the right and left inner edges of the positioning hole 2A restricts the widthwise movement of the positioning projection 103.

As shown in FIGS. 6C-6D, the second attachment section 104 includes an oval hole 104A, which is longer along the widthwise direction. Meanwhile, in the main frame 2, a boss 2C protruding toward the fixer frame 100 is formed in an area where the second attachment section 104 is attached so that the boss 2C is arranged to penetrate through the oval hole 104A. Thus, the rightward end of the fixer frame 100 is supported by the main frame 2 movably in the widthwise direction.

In this regard, the boss 2C is formed to have a height which is greater than a thickness of the second attachment section 104, and a tip of the boss 2C is formed to have the screw S screwed therein. The boss 2C is formed to have a diameter which is smaller than a diameter of the head of the screw S4. Thus, the head of the screw S4 may prevent the second attachment section 104 from being disengaged from the boss 2C.

Referring back to FIG. 4, on an outer surface of the fixer frame 100, a cable CA is arranged to extend through upper and front sides. The cable CA is connected to lateral thermistors (not shown), which detect temperatures of axial end portions of the heat roller 41.

The thermistor plate 120 supports the central thermistor 110. The thermistor plate 120 is a board elongated along the widthwise direction, which is an axial direction of the heat roller 41, and spreads to intersect with the vertical direction, which is the facing direction for the heat roller 41 and the central thermistor 110 to face each other. More specifically, a largest plane 120A in the thermistor plate 120 spreads orthogonally to the vertical direction. In this regard, the orthogonal direction with respect to the vertical direction for the largest plane 120A to spread refers to 90 degrees, and additionally with a margin of error or tolerance of plus or minus 5 degrees, with respect to the vertical direction. The thermistor plate 120 includes a supporting part 121, two (2) first parts 122, two (2) second parts 123, and two (2) attaching parts 124. The supporting part 121 supports the central thermistor 110. The first parts 122 are formed in widthwise adjoining positions with respect to the supporting part 121. The second parts 123 are formed in widthwise adjoining and outward positions with respect to the first parts 122. The attaching parts 124 are formed in widthwise adjoining and outward positions with respect to the second parts 123.

The supporting part 121 is formed in an approximate shape of a rectangular plate, with a front end portion thereof being bent downward. The supporting part 121 includes a pair of supporting pieces 121A, which face each other along the widthwise direction. The supporting part 121 further includes a screw hole 121B, a positioning hole 121C, and an oval hole 121D, which are formed in positions between the pair of supporting pieces 121A. The screw hole 121B is formed to have the screw S1 screwed therein, the positioning hole 121C is formed in a rearward position with respect to the screw hole 121B, and the oval 121D is formed in a frontward position with respect to the screw hole 121B. Each of the supporting pieces 121A is formed by cutting and bending a part of the supporting part 121 to erect upward. The sensor-supporting member 111 of the central thermistor 110 is wedged between the pair of supporting pieces 121A.

The positioning hole 121C is a round opening, which is engageable with a positioning cylindrical boss (not shown) formed in the sensor-supporting member 111. Thus, the central thermistor 110 may be placed in a correct position with respect to the supporting part 121 in the front-rear direction and the widthwise direction.

The oval hole 121D is an opening elongated along the front-rear direction and is engageable with a positioning boss 105, which is arranged in the fixer frame 100.

Each first part 122 is formed in an approximate shape of a rectangular plate, of which dimension (depth) along the front-rear direction (i.e., a direction orthogonal to the axial direction and the facing direction) is smaller than that of the supporting part 121, with a frontend portion thereof being bent downward. The first part 122 has a predetermined degree of rigidity (bending rigidity). A front edge of the first part 122 is located in a same position as a front edge of the supporting part 121, and a rear edge of the first part 122 is located in a frontward recessed position (a position closer to the front) with respect to a rear edge of the supporting part 121.

Each second part 123 is formed in an approximate shape of a rectangular plate, of which dimension (depth) along the front-rear direction is smaller than that of the first part 122, with a frontend portion thereof being bent downward. Due to the smaller dimension in the front-rear direction, rigidity of the second part 123 is lower than the rigidity of the first part 122.

A front edge of the second part 123 is located in the same position as the front edge of the first part 122, and a rear end of each second part 123 is formed to have a cutout 123A (see FIG. 7), which recesses frontward to a position closer to the front with respect to the rear edge of the first part 122.

Each attaching part 124 is a part, at which the thermistor plate 120 is fixed to the attachable surface 102 of the fixer frame 100. A dimension (depth) of the attaching part 124 along the front-rear direction is greater than that of the first part 122 and smaller than that of the supporting part 121. A frontend portion of the attaching part 124 is bent downward. A front edge of the attaching part 124 is located in the same position as a front edge of the second part 123, and a rear edge of the attaching part 124 is formed to protrude rearward, to be farther from the front edge thereof, with respect to the rear edge of the second part 123.

In the rear end of the attaching part 124, a through-hole 124A to insert the screw S3 is formed. In a frontward position with respect to the through-hole 124A, an engageable hole 124B, which is engageable with the positioning projection 102B in the fixer frame 100, is formed. The through-hole 124 is an oval hole elongated along the widthwise direction and is engaged with the screw S3 at front and rear edges thereof. The engageable hole 124B is an oval hole elongated along the widthwise direction and is engaged with the positioning projection 102B at front and rear edges thereof.

Thus, by the engagement of the pair of through-holes 124A at the widthwise outward positions with the screws S1, the engagement of the pair of engageable holes 124B at the widthwise outward positions with the positioning projections 102B, and the engagement of the screw hole 121B at the approximately widthwise central position with the screw S3, the thermistor plate 120 is placed in a correct position with respect to the fixer frame 100 along the front-rear direction. Further, by the engagement of the screw hole 121B and the oval hole 121D at the approximately widthwise central positions with the screw S1 and the positioning boss 105 respectively, the thermistor plate 120 is placed in a correct position with respect to the fixer frame 100 along the widthwise direction.

Meanwhile, in a position between the attaching part 124 on the left in the thermistor plate 120 and a head of the screw S3, the ground piece 140 is wedged. Thereby, the thermistor plate 120 is grounded through the ground piece 140.

Next, the thermistor plate 120 will be described in detail with reference to FIGS. 7A-7B. As shown in FIG. 7A, the second part 123 on the left is arranged to be closer to the attaching part 124 on the left than the first part 122 on the left is, and the second part 123 on the right is arranged to be closer to the attaching part 124 on the right than the first part 122 on the right is.

A length (width) L2 of the first part 122 on the left along the widthwise direction is smaller than a length (width) L1 of the supporting part 121 along the widthwise direction. On the other hand, a length (width) L3 of the first part 122 on the right along the widthwise direction is greater than a length (width) L1 of the supporting part 121 along the widthwise direction. A length (width) L4 of the second part 123 on the left along the widthwise direction is greater than the length L3 of the first part 122 on the right along the widthwise direction. A length (width) L5 of the second part 123 on the right along the widthwise direction is greater than the length L4 of the second part 123 on the left along the widthwise direction.

Thus, the second parts 123 are greater, with regard to the lengths along the widthwise direction, than the first parts 122. In this regard, a length (width) L6 of each attaching part 124 is smaller than the lengths L1-L5 of the other parts (e.g., the length L2 of the first part 122 on the left) in the thermistor plate 120 along the widthwise direction.

Meanwhile, a length (depth) B1 of the supporting part 121 along the front-rear direction is greater than lengths (depths) of the other parts (e.g., a depth B4 of the attaching part 124) along the front-rear direction). A length (depth) B4 of each attaching part 124 along the front-rear direction is smaller than the length B1 of the supporting part 121 along the front-rear direction.

A breadth (depth) B2 of each first part 122 along the front-rear direction is smaller than the breadth B4 of the attaching part 124 along the front-rear direction. A breadth (depth) B3 of each second part 123 along the front-rear direction is smaller than the breadth B2 of the first part 122 along the front-rear direction.

Dimensions of the lengths L1-L6 and the depths B1-B4 may be, for example, but not limited to, as follows: L1=35.0 mm, L2=25.6 mm, L3=43.9 mm, L4=54 mm, L5=67 mm, L6=10.6 mm, B1=18.6 mm, B2=11.6 mm, B3=10.6 mm, B4=15.0 mm. A thickness of the thermistor plate 120 may be, for example, but not limited to, 1.0 mm.

As shown in FIGS. 7A-7B, a dimension of the supporting piece 121A on the left along the front-rear direction is greater a dimension of the supporting piece 121A on the right along the front-rear direction. A front end and a rear end of the supporting piece 121A on the left protrudes frontward and rearward (outwardly) respectively from a front end and a rear end of the supporting piece 121A on the left, when viewed along the widthwise direction.

As shown in FIG. 8, the rear ends of the second parts 123 face with the cable CA, which is drawn along the outer surface of the fixer frame 100, along the front-rear direction. Therefore, as the rear ends of the second parts 123 recessed frontward with respect to the rear ends of the first parts 122 are placed to face with the cable CA, the cable CA may be prevented from being damaged by the rear ends of the thermistor plate 120.

The fixer frame 100 of the fixing device 18 configured as above may be affected by, for example, the heat from the halogen lamp 60 and the urging force to urge the pressure roller 42 against the heat roller 41. Accordingly, the fixer frame 100 may be bowed in an arch and protrude downward at the widthwise central portion thereof. If the fixer frame 100 is bowed, as illustrated in FIG. 9, the attachable surfaces 102, to which the widthwise ends of the thermistor plate 120 are attached, may be distorted to incline inwardly and obliquely upward with regard to the widthwise direction. Thus, the widthwise ends of the thermistor plate 120 may be subject to bending moment.

In this regard, if the thermistor plate was formed to have a constant breadth throughout the widthwise length, except for the central part to support the thermistor, as it is in the conventionally known thermistor plate, the thermistor plate might be excessively bowed downward, as indicated by broken lines in FIG. 9. On the other hand, the thermistor plate 120 according to the present embodiment is provided with the second parts 123 on the right and left, of which breadth is smaller and of which rigidity is lower than the first parts 122, between the supporting part 121 and the attaching parts 124 on the right and left respectively. Therefore, while the second parts 123 with the lower rigidity may be regionally deformed, the supporting part 121 at the approximately widthwise center may be prevented from being bowed excessively downward.

Thus, while the bowing amount of the supporting part 121 to bow downward is restricted, excessive positional changes of the central thermistor 110 along the vertical direction may be restricted. Accordingly, it may be restrained that the gap between the central thermistor 110 and the heat roller 41 is varied largely.

According to the present invention, the second parts 123 of the thermistor plate 120 are arranged at outward positions along the widthwise direction, in the positions closer to the attaching parts 124, with respect to the first parts 122. Therefore, the second parts 123 with the lower rigidity at the positions closer to the attaching parts 124 may be regionally deformed. Accordingly, the bowing amounts of the first parts 122 and the supporting part 121, which are inward positions with respect to the second parts 123, may be restrained. Therefore, it may be restrained that the gap between the central thermistor 110 supported by the supporting part 121 and the heat roller 41 is varied largely.

Further, according to the present embodiment, the dimensions of the second parts 123 along the widthwise direction are greater than the dimensions of the first parts 122 along the widthwise direction; therefore, the second parts 123 may be intentionally and preferably deformed rather than the other parts in the thermistor plate 120.

Further, according to the present embodiment, the first attachment section 103 on the left of the fixer frame 100 is fixed to the main frame 2 immovably in any direction, while the second attachment section 104 on the right is supported movably with respect to the main frame 2. Therefore, when the fixer frame 100 thermally expands, the right-hand side of the fixer frame 100 is allowed to deform outwardly along the widthwise direction while the left-hand side of the fixer frame 100 stays steadily. When the right-hand side of the fixer frame 100 deforms outwardly along the widthwise direction, the right-hand side of the thermistor plate 120 may bear a larger amount of bending moment than the left-hand side.

In this regard, however, according to the present embodiment, the length L5 of the second part 123 on the right is greater than the length L4 of the second part 123 on the left. Therefore, with the extra length of the second part 123 on the right, the effect by the larger bending moment applied to the right-hand side of the thermistor plate 120 may be absorbed by deformation of the second part 123 on the right, which is larger than the second part 123 on the left. Accordingly, the bowing amount for the supporting part 121 to bow downward may be restrained, and the gap between the central thermistor 110 supported by the supporting part 121 and the heat roller 41 may be prevented from being varied largely.

Further, according to the present embodiment, the front end of the thermistor plate 120 is bent; therefore, rigidity of the entire thermistor plate 120 may be improved.

Although an example of carrying out the invention have been described, those skilled in the art will appreciate that there are numerous variations and permutations of the fixing device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Some of the exemplary variations will be described below. In the following examples, items or structures which are the same as or similar to the items or the structures described in the previous embodiment will be referred to by the same reference signs, and description of those will be omitted.

For example, forms of the thermistor plate may not necessarily be limited to the form described above. As shown in FIG. 10A, a thermistor plate 210 may have two (2) first parts 122 on each side of the supporting part 121 (i.e., total four (4) first parts 122) along the widthwise direction.

In particular, two of the first parts 122 on the left may be located in positions between the attaching part 124 on the left and the supporting part 121, and on each side of the second part 123 on the left along the widthwise direction. Two of the first parts 122 on the right may be located in positions between the attaching part 124 on the right and the supporting part 121, and on each side of the second part 123 on the right along the widthwise direction.

In this regard, an end of the second part 123 on the side of the attaching part 124 on the left, i.e. a leftward end of the second part 123 on the left, may be closer to the attaching part 124 on the left rather than to the supporting part 121. In other words, the leftward end of the second part 123 on the left may be located on an outer side with respect to a first intermediate line CL1, between the attaching part 124 on the left and the supporting part 121 (i.e., between the attaching part 124 on the left and the supporting part 121, and apart from the attaching part 124 on the left and from the supporting part 121 for an equal distance) along the widthwise direction.

Similarly, an end of the second part 123 on the side of the attaching part 124 on the right, i.e., a rightward end of the second part 123 on the right, may be closer to the attaching part 124 on the right rather than to the supporting part 121. In other words, the rightward end of the second part 123 on the right may be located on an outer side with respect to a second intermediate line CL2, between the attaching part 124 on the right and the supporting part 121 (i.e., between the attaching part 124 on the right and the supporting part 121, and apart from the attaching part 124 on the right and from the supporting part 121 for an equal distance), along the widthwise direction.

With the outward ends of the right and left second parts 123 being placed in the deviated positions closer to the right and left attaching part 124 respectively, the parts closer to the widthwise ends of the thermistor plate 210 may be regionally and effectively deformed so that bowing in the central position, where the supporting part 121 is located, may be restricted.

In this configuration, a distance between the rightward end of the second part 123 on the right and the attaching part 124 on the right may be smaller than a distance between a leftward end of the second part 123 on the right and the supporting part 121. In other words, the second part 123 on the right may be located in a position deviated to be closer to the attaching part 124 on the right rather than to the supporting part 121 along the widthwise direction. Therefore, the area in the vicinity of the rightward end of the thermistor plate 210, which may be subject to the larger bending moment, may be regionally deformed so that bowing in the central position, where the supporting part 121 is located, may be restricted.

For another example, a thermistor plate 220 as shown in FIG. 10B may be provided. The thermistor plate 220 may be in the similar form to the thermistor plate 210 (FIG. 10A) described above, but the second parts 221 may be formed to have a smaller breadth along the front-rear direction than a breadth of the second parts 123 in the former example. In other words, a depth of cutouts 221A, which are formed in the positions of the second parts 221, along the front-rear direction may be greater than a depth of the cutouts 123A of the second parts 123 shown in FIG. 10A.

For another example, a thermistor plate 230 as shown in FIG. 10C may be provided. The thermistor plate 230 may be in the similar form to the thermistor plate 220 (FIG. 10B) described above, but the cutouts may be elongated along the widthwise direction to reach the attaching parts 124. In other words, second parts 231 in the example shown in FIG. 10C may have a smaller breadth along the front-rear direction than the breadth of the second parts 123 shown in FIG. 10A, and the second parts 231 may be extended from the first parts 122, which adjoin the supporting part 121, to the attaching parts 124.

In this regard, the second part 231 on the left may be extended across the first intermediate line CL1 along the widthwise direction, and a length of a leftward portion of the second part 231 on the left with respect to the first intermediate line CL1 (i.e., a portion of the second part 231 on the left closer to the attaching part 124) is greater than a length of a rightward portion of the second part 231 on the left with respect to the first intermediate line CL1 (i.e., a portion of the second part 231 on the left closer to the supporting part 121).

For another example, a thermistor plate 240 as shown in FIG. 11A may be provided. The thermistor plate 240 may be in the similar form to the thermistor plate 120 (FIG. 7) described above, but the lengths of the second parts 241 along the widthwise direction may be smaller than the lengths of the first parts 122. Further, the breadth of the second parts 241 along the front-rear direction may be smaller than the breadth of the second parts 123 in the former embodiment. Moreover, the second parts 241 may each be located in a position between the first intermediate line CL1 and the attaching part 124 on the left, and in a position between the second intermediate line CL2 and the attaching part 124 on the right. In other words, the second parts 241 may be located in outward deviated positions closer to the attaching parts 124 along the widthwise direction with respect to the intermediate lines CL1, CL2, respectively.

For another example, a thermistor plate 250 as shown in FIG. 11B may be provided. The thermistor plate 250 may be in the similar form to the thermistor plate 240 (FIG. 11A) described above with the two (2) second parts 241, which may be in the same form as the second parts 241 in the thermistor plate 240. The second parts 241 in the thermistor plate 250 may be, however, located in inward positions along the widthwise direction with respect to the second parts 241 of the thermistor plate 240 described above. In this regard, the first parts 122 may be provided on an outer side of each second part 241, in a position between the second part 241 and the attaching part 124, along the widthwise direction.

More specifically, the second part 241 on the left may be arranged in a deviated position between the attaching part 124 on the left and the first intermediate line CL1, to be closer to the first intermediate line CL1 rather than to the attaching part 124. The second part 241 on the right may be arranged in a position between the attaching part 124 on the right and the second intermediate line CL2, to be apart from the attaching part 124 on the right and the second intermediate line CL2 for an equal distance.

For another example, a thermistor plate 260 as shown in FIG. 11C may be provided. The thermistor plate 260 may be in the similar form to the thermistor plate 250 (FIG. 11B) described above, but the second parts 241 may be located in further inward positions along the widthwise direction with respect the attaching parts 124 than the second parts 241 in the thermistor plate 250 described above. More specifically, the second part 231 on the left may be arranged across the first intermediate line CL1 along the widthwise direction, and a length of a leftward portion of the second part 241 on the left with respect to the first intermediate line CL1 (i.e., a portion of the second part 241 on the left closer to the attaching part 124) is smaller than a length of a rightward portion of the second part 241 on the left with respect to the first intermediate line CL1 (i.e., a portion of the second part 241 on the left closer to the supporting part 121).

Meanwhile, the second part 241 on the right is arranged in a deviated position between the attaching part 124 on the right and the second intermediate line CL2, to be closer to the second intermediate line CL 2 rather than to the attaching part 124 on the right.

For another example, the first part 122 and the second part 123 may not necessarily be arranged on each side of the supporting part 121 along the widthwise direction, but the first part 122 and the second part 123 may be arranged solely on one side of the supporting part 121 along the widthwise direction. However, with the first part 122 and the second part 123 on each side of the supporting part 121 along the widthwise direction, the second parts 123, of which rigidity is relatively small within the thermistor plate 120, in the two (2) positions may be effectively and regionally deformed when the widthwise ends of the thermistor plate 120 are subject to the bending moment. Accordingly, the bowing amount at the supporting part 121 may be effectively restricted. Therefore, it may be preferable that the first part 122 and the second part 123 are arranged on each side of the supporting part 121 along the widthwise direction.

For another example, the second parts 123 may not necessarily be formed to be smaller in the breadth along the front-rear direction than the first parts 122 in order to lower the rigidity thereof, but the rigidity of the second parts 123 may be lowered to be smaller than the first parts 122 by, for example, forming holes in the second parts 123.

For another example, the embodiments described above may not necessarily be applied to a laser printer but may be employed in, for example, a monochrome printer, a copier, or a multifunction peripheral device.

Below are described results of exemplary experiments with the thermistor plates according to the embodiments described above. In the experiment, interrelation among the depths or the width of the cutouts (i.e., the second parts) formed in the thermistor plates, stress caused in the cutouts, and amounts of the gap between the central thermistor 110 and the heat roller 41 was examined. In particular, an analysis model for the fixing device was prepared, the analysis model was placed to experience simulations with a plurality of different conditions of forces and heats, and stress caused in the cutouts and amounts of the gap variation were observed. The conditions for the simulations are as described below.

1. Analysis Model for the Fixing Device

An analysis model, which is in a configuration corresponding to the fixing device 18 as shown in the accompanying drawings including FIGS. 2-4, is prepared. In the analysis model, the bearing 71 on the left is fixed to the heat roller 41, and the bearing 71 on the right is not necessarily fixed to the heat roller 41 but is placed to contact the heat roller 41. The central thermistor 110, the screw S1, and the thermistor plate 120 are integrally fixed to one another. The thermistor plate 120, the screws S2, and the fixer frame 100 are integrally fixed to one another.

As a material for the fixer frame 100, FC01 is adopted. As a material for the thermistor plate 120 and the heat roller 41, steel is adopted. For the central thermistor 110, a rigid body is adopted. As a material for the bearings 71, polyoxyme thylene (POM) is adopted.

As shown in FIG. 13, Young's modulus for the fixer frame 100 with regard to the widthwise direction, which is a machine direction of the resin when the fixer frame 100 is formed, is set to 7810 MPa, while a linear expansion coefficient is set to a range between $9.7*10^{-6}/°$ C. and $27*10^{-5}/°$ C. Young's modulus for the fixer frame 100 with regard to a direction orthogonal to the widthwise direction, which is a cross direction with respect to the machine direction, is set to 4470 Mpa, while a linear expansion coefficient is set to a range between $65*10^{-6}/°$ C. and $91*10^{-6}/°$ C. Young's modulus for the steel is set to 20300 MPa, while a linear expansion coefficient is set to $8.3*10^{-6}/°$ C. Young's modulus for the POM is set to 2000 MPa, while a linear expansion coefficient is set to $90*10^{-6}/°$ C.

2. Stress Applied to the Fixing Device

Directional components P1-P4 and a force P5 (see FIGS. 12A-12B) are adopted based on designed loads. The directional component P1 and the directional component P are a force in the vertical direction and a force in the front-rear direction to be applied to the heat roller 41 from the pressure roller 42 respectively. The directional component P3 and the directional component P4 are a force in the vertical direction and a force in the front-rear direction to be applied to the fixer frame 100 from a rotation center of the supporting arms 47, which support the pressure roller 42, respectively. The force P5 is applied to the fixer frame 100 from tension springs 48, which pull the supporting arms 47 toward the fixer frame 100. The force P5 is set to be applied to each widthwise end of the fixer frame 100.

More specifically, the forces for the directional components P1, P2, P3, P4, and P5 are set to be 71.62N, 47.37N, 27.03N, 47.37N, and 44.59N respectively.

3. Thermal Condition

Heat of 150° C. was applied to each part in the fixing device 18. In particular, each part is heated, starting from 22° C. up to 150° C. gradually and evenly.

4. Form of the Thermistor

As shown in FIG. 14, a thermistor plate 120 configured similarly to the thermistor plates described above, which include a supporting part 121, two (2) first parts 122, two (2) second parts 123, and two (2) attaching parts 124, is prepared. A length L11 of the entire thermistor plate 120 along the widthwise direction is set to 246.3 mm, a distance L12 between a leftward end of the thermistor plate 120 and a leftward end of the attaching part 124 on the right along the widthwise direction is set to 236.1 mm, a distance L13 between the leftward end of the thermistor plate 120 and a leftward end of the supporting part 121 along the widthwise direction is set to 90.2 mm, a length L14 of the supporting part 121 along the widthwise direction is set to 35 mm, and a length L15 of the attaching part 124 on the left along the widthwise direction is set to 10.6 mm. A thickness of the thermistor plate 120 is set to 1.0 mm. For a width X along the widthwise direction and a depth Y along the front-rear direction of a cutout 123A, a plurality of patterns are prepared.

In particular, in a first simulation, the width X is maintained at 20 mm at all time, while the depth Y is varied each time to 0.5 mm, 1 mm, 1.5 mm, 2 mm, 2.5 mm, 3 mm, 3.5 mm, 4 mm, and 4.5 mm.

In a second simulation, the depth Y is maintained at 2.5 mm at all time, while the width X is varied each time to 20 mm, 30 mm, 40 mm, 50 mm, and 60 mm. Further, in a third simulation, the depth Y is maintained at 2.5 mm at all time, while the width X is varied each time to 35 mm, 37.5 mm, and 40 mm. When the width X of the cutout 123A is widened or narrowed, a position of an outer edge of the cutout 123A with regard to the widthwise direction is maintained steady, while an inner edge of the cutout 123A is moved inwardly to widen the cutout 123A or outwardly to narrow the cutout 123A along the widthwise direction.

FIGS. 15-17 show results obtained from the first though third simulations. In FIGS. 15-17, the bar graphs illustrate stresses caused in the cutouts 123A. The line graphs illustrate varied amounts of the gap.

As shown in FIG. 15, through the first simulation, it is observed that the stress in the cutouts 123A increases to be larger as the depth Y of the cutouts 123A is enlarged to be deeper. Further, it is observed that the amount of the gap is reduced to be smaller as the depth Y of the cutouts 123A is enlarged to be deeper.

As shown in FIG. 16, through the second simulation, it is observed that the stress in the cutouts 123A is reduced to be smaller as the width X of the cutouts 123A is enlarged to be wider. Further, it is observed that the amount of the gap is reduced to be smaller as the width X of the cutouts 123A is enlarged to be wider when the width X of the cutouts 123A is approximately in a range between 20 mm and 40 mm, and the amount of the gap is enlarged to be larger as the width X of the cutouts 123A is enlarged to be wider when the width X of the cutouts 123A is approximately in a range between 40 mm and 60 mm.

Through the third simulation, in which the width X of the cutouts 123A are varied at the smaller interval within a range in proximity to 40 mm, as shown in FIG. 17, it is observed that the amount of the gap is minimized when the width X is set to 37.5 mm.

According to the simulations described above, it is observed that the depth Y of the cutouts 123A may preferably be in one of ranges between 0.1 mm and 6.0 mm; 0.5 mm and 4.5 mm; and 1.0 mm and 3.0 mm. Meanwhile, the width X of the cutouts 123A may preferably be in one of ranges between 10 mm and 80 mm; 20 mm and 60 mm; and 30 mm and 50 mm. Moreover, in consideration of the stress caused in the cutouts 123A and the gap amount in total, it is observed to be preferable that the depth Y may be 1 mm, and the width X may be 37.5 mm.

It is reminded, however, that the dimension of each part may not necessarily depend on the results observed in the simulations or limited to the dimensions described above.

What is claimed is:

1. A fixing device, comprising:

a heat roller;

a thermistor arranged to face an outer periphery of the heat roller in a facing direction and configured to detect temperature of the heat roller;

a supporting member formed in a shape of a plate elongated along an axial direction of the heat roller and spreading to intersect with the facing direction, the supporting member being configured to support the thermistor; and a fixer frame configured to support end portions of the heat roller and end portions of the supporting member, wherein the supporting member comprises:

a supporting part configured to support the thermistor;

a first part having a predetermined degree of rigidity;

a second part, of which rigidity is lower than the rigidity of the first part; and an attaching part configured to be attached to an attachable surface of the fixer frame, the attachable surface spreading orthogonally to the facing direction, wherein the supporting part, the first part, the second part, and the attaching part are arranged such that:

the attaching part is arranged on one end of the supporting member along the axial direction, the supporting part is arranged in an intermediate position along the axial direction in the supporting member, and the first part and the second part are arranged in positions between the attaching part and the supporting part along the axial direction in the supporting member, wherein the supporting member is arranged to spread orthogonally to the facing direction, wherein the attachable surface is arranged to spread orthogonally to the facing direction, and wherein the second part is arranged to be closer to the attaching part than the first part is.

2. The fixing device according to claim 1, wherein an end of the second part on a side of the attaching part is closer to the attaching part rather than to the supporting part.

3. The fixing device according to claim 2, wherein a distance between the end of the second part on the side of the attaching part and the attaching part is smaller than a distance between an end of the second part on a side of the supporting part and the supporting part.

4. The fixing device according to claim 1, wherein the first part, the second part, and the attaching part are arranged on each side of the supporting member.

5. The fixing device according to claim 1, wherein a dimension of the second part along an orthogonal direction, which is orthogonal to the axial direction and to the facing direction, is smaller than a dimension of the first part along the orthogonal direction.

6. The fixing device according to claim 5, wherein a first edge of the second part on a first side along the orthogonal direction is located in a same position with regard to the orthogonal direction as a first edge of the first part on the first side, and a second edge of the second part on a second side along the orthogonal direction is located to be closer to the first side than a second edge of the first part on the second side.

7. The fixing device according to claim 6, wherein, a first edge of the supporting part on the first side along the orthogonal direction is located in the same position with regard to the orthogonal direction as the first edge of the first part on the first side, and a second edge of the supporting part on the second side is located to be farther from the first side than the second edge of the first part on the second side, and wherein end portions of the first part, the second part, and the supporting part on the first side are bent.

8. The fixing device according to claim 6, wherein the second edge of the second part on the second side is arranged to face a cable which is arranged along an outer surface of the fixer frame.

9. The fixing device according to claim 1, wherein, with regard to the axial direction, the second part is larger than the first part.

10. An image forming apparatus, comprising:

a fixing device, comprising:

a heat roller;

a thermistor arranged to face an outer periphery of the heat roller in a facing direction and configured to detect temperature of the heat roller;

a supporting member formed in a shape of a plate elongated along an axial direction of the heat roller and spreading to intersect with the facing direction, the supporting member being configured to support the thermistor; and a fixer frame configured to support end portions of the heat roller and end portions of the supporting member; and a main frame configured to support the fixing device, wherein the supporting member comprises:

a supporting part configured to support the thermistor;

a first part having a predetermined degree of rigidity;

a second part, of which rigidity is lower than the rigidity of the first part; and an attaching part configured to be attached to an attachable surface of the fixer frame, the attachable surface spreading orthogonally to the facing direction, wherein the supporting part, the first part, the second part, and the attaching part are arranged such that:

the attaching part is arranged on one end of the supporting member along the axial direction, the supporting part is arranged in an intermediate position along the axial direction in the supporting member, and the first part and the second part are arranged in positions between the attaching part and the supporting part along the axial direction in the supporting member, wherein the supporting member is arranged to spread orthogonally to the facing direction, wherein the attachable surface is arranged to spread orthogonally to the facing direction, wherein the first part, the second part, and the attaching part are arranged on each side of the supporting member, wherein an end portion of the fixer frame on a first side along the axial direction is restricted by the main frame from moving in the axial direction, wherein another end portion of the fixer frame on a second side along the axial direction is supported by the main frame to be movable in the axial direction, and wherein the second part of the supporting member on the second side is greater than the second part on the first side with regard to the axial direction.

11. A fixing device, comprising:

a heat roller;

a thermistor arranged to face an outer periphery of the heat roller in a facing direction and configured to detect temperature of the heat roller;

a supporting member formed in a shape of a plate elongated along an axial direction of the heat roller and spreading to intersect with the facing direction, the supporting member being configured to support the thermistor; and a fixer frame configured to support end portions of the heat roller and end portions of the supporting member, wherein the supporting member comprises:

a supporting part configured to support the thermistor;

a first part having a predetermined degree of rigidity;

a second part, of which rigidity is lower than the rigidity of the first part; and an attaching part configured to be attached to an attachable surface of the fixer frame, the attachable surface spreading orthogonally to the facing direction, wherein the supporting part, the first part, the second part, and the attaching part are arranged such that:

the attaching part is arranged on one end of the supporting member along the axial direction, the supporting part is arranged in an intermediate position along the axial direction in the supporting member, and the first part and the second part are arranged in positions between the attaching part and the supporting part along the axial direction in the supporting member, wherein the supporting member is arranged to spread orthogonally to the facing direction, wherein the attachable surface is arranged to spread orthogonally to the facing direction, wherein an end of the second part on a side of the attaching part is closer to the attaching part rather than to the supporting part, and wherein a distance between the end of the second part on the side of the attaching part and the attaching part is smaller than a distance between an end of the second part on a side of the supporting part and the supporting part.

12. The fixing device according to claim 11, wherein the first part, the second part, and the attaching part are arranged on each side of the supporting member.

13. The fixing device according to claim 11, wherein a dimension of the second part along an orthogonal direction, which is orthogonal to the axial direction and to the facing direction, is smaller than a dimension of the first part along the orthogonal direction.

14. The fixing device according to claim 13, wherein a first edge of the second part on a first side along the orthogonal direction is located in a same position with regard to the orthogonal direction as a first edge of the first part on the first side, and a second edge of the second part on a second side along the orthogonal direction is located to be closer to the first side than a second edge of the first part on the second side.

15. The fixing device according to claim 14, wherein, a first edge of the supporting part on the first side along the orthogonal direction is located in the same position with regard to the orthogonal direction as the first edge of the first part on the first side, and a second edge of the supporting part on the second side is located to be farther from the first side than the second edge of the first part on the second side, and wherein end portions of the first part, the second part, and the supporting part on the first side are bent.

16. The fixing device according to claim 14, wherein the second edge of the second part on the second side is arranged to face a cable which is arranged along an outer surface of the fixer frame.

17. The fixing device according to claim 11, wherein, with regard to the axial direction, the second part is larger than the first part.

18. A fixing device, comprising:

a heat roller;

a thermistor arranged to face an outer periphery of the heat roller in a facing direction and configured to detect temperature of the heat roller;

a supporting member formed in a shape of a plate elongated along an axial direction of the heat roller and spreading to intersect with the facing direction, the supporting member being configured to support the thermistor; and a fixer frame configured to support end portions of the heat roller and end portions of the supporting member, wherein the supporting member comprises:

a supporting part configured to support the thermistor;

a first part having a predetermined degree of rigidity;

a second part, of which rigidity is lower than the rigidity of the first part; and an attaching part configured to be attached to an attachable surface of the fixer frame, the attachable surface spreading orthogonally to the facing direction, wherein the supporting part, the first part, the second part, and the attaching part are arranged such that:

the attaching part is arranged on one end of the supporting member along the axial direction, the supporting part is arranged in an intermediate position along the axial direction in the supporting member, and the first part and the second part are arranged in positions between the attaching part and the supporting part along the axial direction in the supporting member, wherein the supporting member is arranged to spread orthogonally to the facing direction, wherein the attachable surface is arranged to spread orthogonally to the facing direction, wherein a dimension of the second part along an orthogonal direction, which is orthogonal to the axial direction and to the facing direction, is smaller than a dimension of the first part along the orthogonal direction, and wherein a first edge of the second part on a first side along the orthogonal direction is located in a same position with regard to the orthogonal direction as a first edge of the first part on the first side, and a second edge of the second part on a second side along the orthogonal direction is located to be closer to the first side than a second edge of the first part on the second side.

19. The fixing device according to claim 18, wherein an end of the second part on a side of the attaching part is closer to the attaching part rather than to the supporting part.

20. The fixing device according to claim 18, wherein the first part, the second part, and the attaching part are arranged on each side of the supporting member.

21. The fixing device according to claim 18, wherein, a first edge of the supporting part on the first side along the orthogonal direction is located in the same position with regard to the orthogonal direction as the first edge of the first part on the first side, and a second edge of the supporting part on the second side is located to be farther from the first side than the second edge of the first part on the second side, and wherein end portions of the first part, the second part, and the supporting part on the first side are bent.

22. The fixing device according to claim 18, wherein the second edge of the second part on the second side is arranged to face a cable which is arranged along an outer surface of the fixer frame.

23. The fixing device according to claim 18, wherein, with regard to the axial direction, the second part is larger than the first part.

* * * * *